US008366374B2

(12) United States Patent
Ishii

(10) Patent No.: US 8,366,374 B2
(45) **Date of Patent: *Feb. 5, 2013**

(54) DUAL ARM WORKING MACHINE

(75) Inventor: Akinori Ishii, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 756 days.

This patent is subject to a terminal disclaimer.

(21) Appl. No.: 12/522,203

(22) PCT Filed: Sep. 19, 2008

(86) PCT No.: PCT/JP2008/066998

§ 371 (c)(1),
(2), (4) Date: Jul. 6, 2009

(87) PCT Pub. No.: WO2009/087795

PCT Pub. Date: Jul. 16, 2009

(65) Prior Publication Data

US 2011/0150615 A1 Jun. 23, 2011

(30) Foreign Application Priority Data

Jan. 7, 2008 (JP) ..... 2008-000717

(51) Int. Cl.
*E02F 3/43* (2006.01)

(52) U.S. Cl. ..... 414/699; 701/50; 700/213

(58) Field of Classification Search ..... 414/680, 414/699; 701/50; 700/213
See application file for complete search history.

(56) References Cited

U.S. PATENT DOCUMENTS 8,137,047 B2 * 3/2012 Ishii et al. ..... 414/699

FOREIGN PATENT DOCUMENTS

| | | | |
|---|---|---|---|
| EP | 0 816 576 | A1 | 1/1998 |
| JP | 6-42014 | A | 2/1994 |
| JP | 11-181815 | A | 7/1999 |
| JP | 2005-232950 | A | 9/2005 |
| JP | 2006-70456 | A | 3/2006 |
| JP | 2007-319962 | A | 12/2007 |

* cited by examiner

*Primary Examiner* — Donald Underwood
(74) *Attorney, Agent, or Firm* — Mattingly & Malur, PC

(57) ABSTRACT

A dual arm hydraulic excavator 200 has two front work devices A and B, provided on left and right sides of a front portion of an upper swing structure 3 and swingable in a top-bottom direction of excavator 200. Front work devices A and B have arms 12*a*, 12*b*, booms 10*a*, 10*b* and working devices 20*a*, 20*b*. An average of angle θa of the arm 12*a* relative to the boom 10*a* and angle θb of the arm 12*b* relative to the boom 10*b* is defined as an average arm angle θc. A range of the average arm angle, in which the average arm angle θc is larger than a predetermined threshold value θc2, is defined as an unstable range N. A range of the average arm angle, from an inner side of the unstable range and adjacent to the unstable range, is defined as a stable state limit range M.

13 Claims, 11 Drawing Sheets

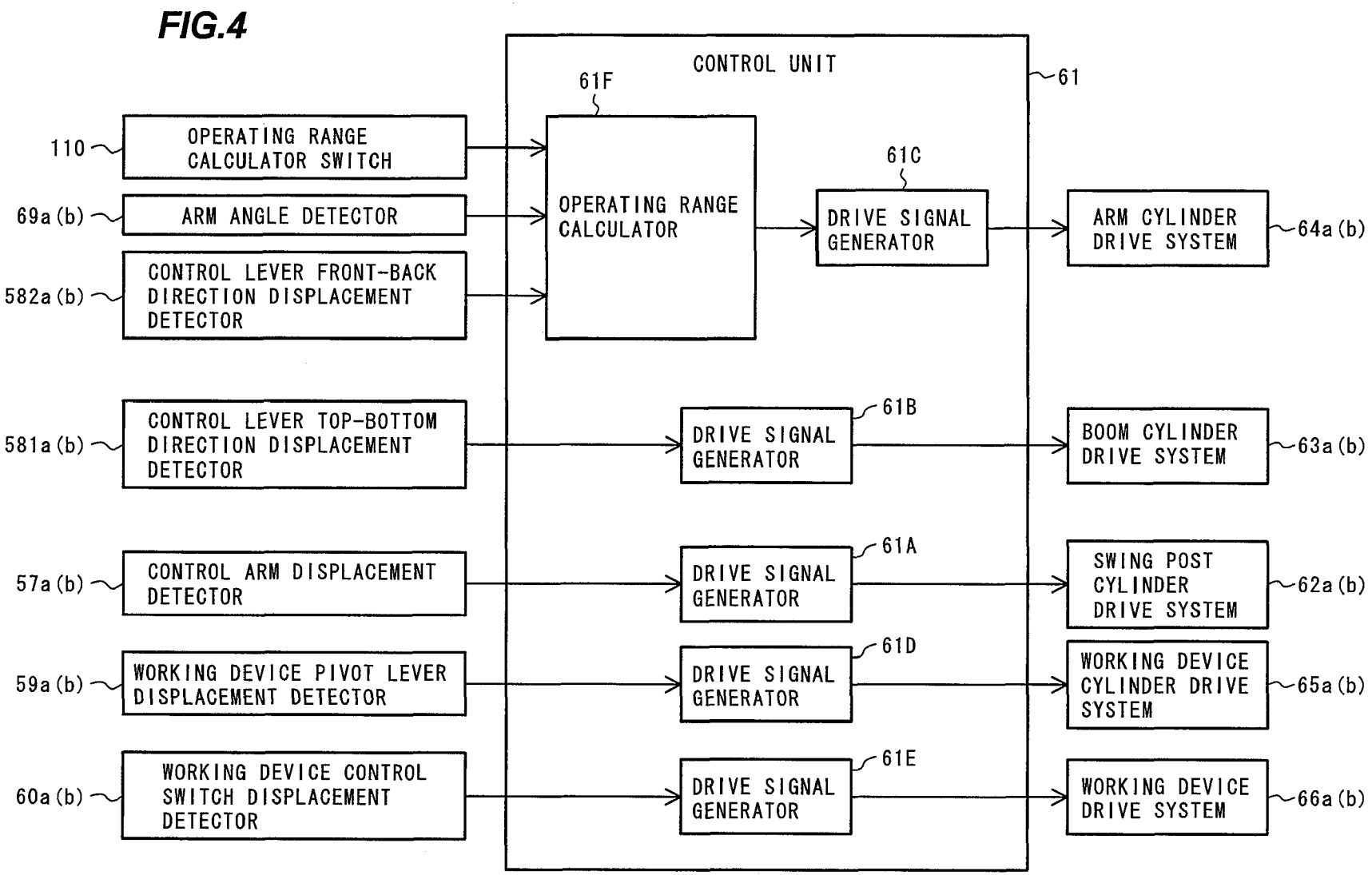
FIG.4
CONTROL UNIT
61
61F
OPERATING RANGE CALCULATOR
61C
DRIVE SIGNAL GENERATOR
61B
DRIVE SIGNAL GENERATOR
61A
DRIVE SIGNAL GENERATOR
61D
DRIVE SIGNAL GENERATOR
61E
DRIVE SIGNAL GENERATOR
ARM CYLINDER DRIVE SYSTEM
64a(b)
BOOM CYLINDER DRIVE SYSTEM
63a(b)
SWING POST CYLINDER DRIVE SYSTEM
62a(b)
WORKING DEVICE CYLINDER DRIVE SYSTEM
65a(b)
WORKING DEVICE DRIVE SYSTEM
66a(b)
OPERATING RANGE CALCULATOR SWITCH
110
ARM ANGLE DETECTOR
69a(b)
CONTROL LEVER FRONT-BACK DIRECTION DISPLACEMENT DETECTOR
582a(b)
CONTROL LEVER TOP-BOTTOM DIRECTION DISPLACEMENT DETECTOR
581a(b)
CONTROL ARM DISPLACEMENT DETECTOR
57a(b)
WORKING DEVICE PIVOT LEVER DISPLACEMENT DETECTOR
59a(b)
WORKING DEVICE CONTROL SWITCH DISPLACEMENT DETECTOR
60a(b)

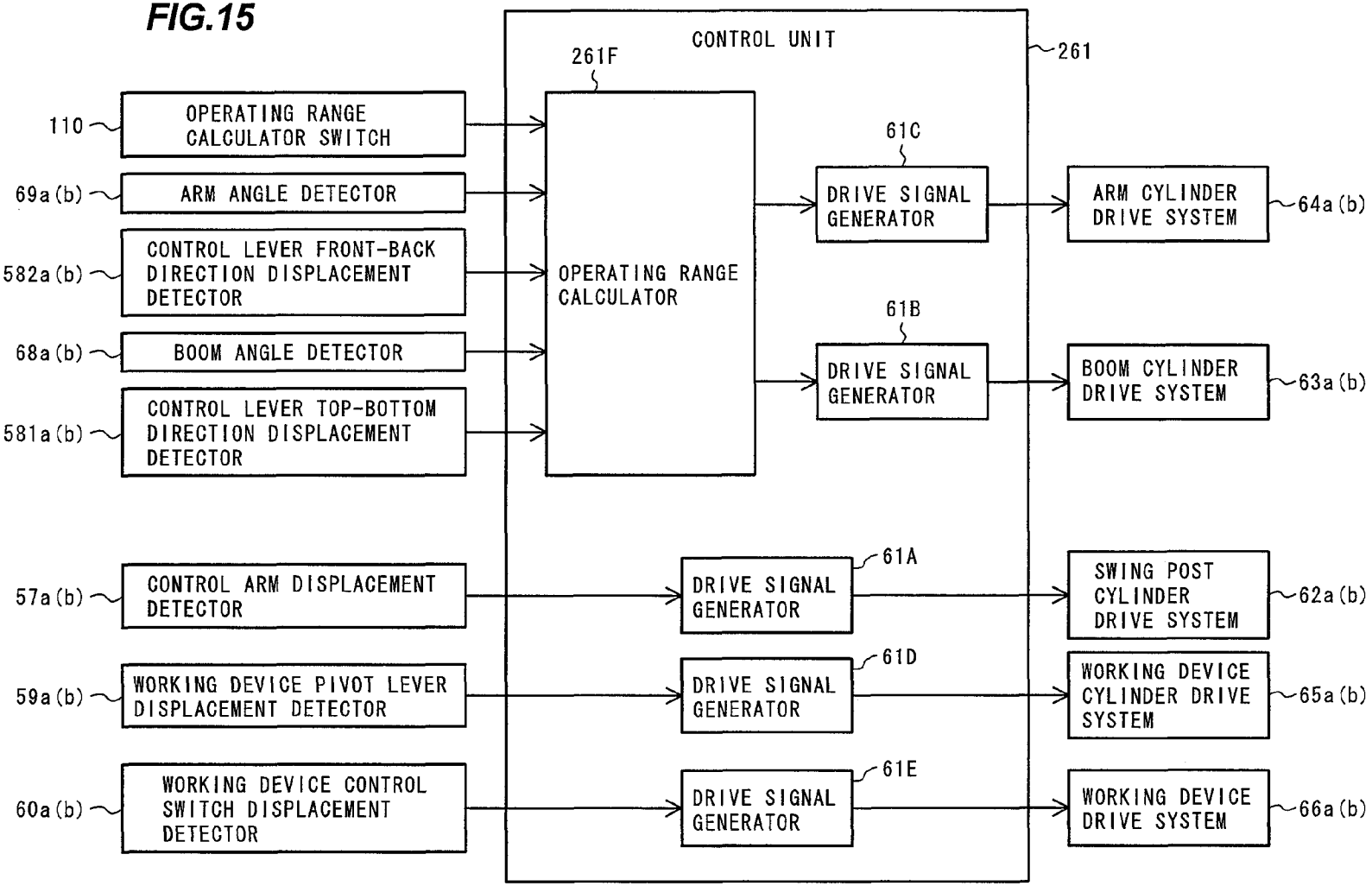
FIG.15
CONTROL UNIT
261
261F
OPERATING RANGE CALCULATOR
61C
DRIVE SIGNAL GENERATOR
61B
DRIVE SIGNAL GENERATOR
61A
DRIVE SIGNAL GENERATOR
61D
DRIVE SIGNAL GENERATOR
61E
DRIVE SIGNAL GENERATOR
ARM CYLINDER DRIVE SYSTEM
64a(b)
BOOM CYLINDER DRIVE SYSTEM
63a(b)
SWING POST CYLINDER DRIVE SYSTEM
62a(b)
WORKING DEVICE CYLINDER DRIVE SYSTEM
65a(b)
WORKING DEVICE DRIVE SYSTEM
66a(b)
OPERATING RANGE CALCULATOR SWITCH
110
ARM ANGLE DETECTOR
69a(b)
CONTROL LEVER FRONT-BACK DIRECTION DISPLACEMENT DETECTOR
582a(b)
BOOM ANGLE DETECTOR
68a(b)
CONTROL LEVER TOP-BOTTOM DIRECTION DISPLACEMENT DETECTOR
581a(b)
CONTROL ARM DISPLACEMENT DETECTOR
57a(b)
WORKING DEVICE PIVOT LEVER DISPLACEMENT DETECTOR
59a(b)
WORKING DEVICE CONTROL SWITCH DISPLACEMENT DETECTOR
60a(b)

DUAL ARM WORKING MACHINE

TECHNICAL FIELD

The present invention relates to a working machine used to demolish works for structures and wastes, road construction, building construction, civil engineering construction and the like, and more particularly to a dual arm working machine having two multi-joint front work devices.

BACKGROUND ART

A working machine such as a hydraulic excavator typically has an upper swing structure and a multi-joint front work device composed of a boom and an arm. The multi-joint work device is coupled to the upper swing structure and can be lifted and lowered. A bucket is attached to an end portion of the arm and can be lifted and lowered. Instead of the bucket, the working machine may have a breaker, crasher, grapple or the like attached to the arm to demolish works for structures and wastes, civil engineering construction and the like. The working machine of this type typically has a single front work device. In recent years, however, a working machine (dual arm working machine) has had two front work devices provided on the left and right sides of a front portion of an upper swing structure, as described in Patent Document 1.

Patent Document 1: JP-A-11-181815

DISCLOSURE OF THE INVENTION

Problems to be Solved by the Invention

Since the dual arm working machine has the two front work devices, the dual arm working machine can use one of the front work devices to dismantle an object and use the other of the front work devices to hold another object, for example. The dual arm working machine can perform operations that are difficult for a single arm working machine having a single front work device. The dual arm working machine has an advantage in terms of stability and efficiency of the operations.

The total weight of the two front work devices of the dual arm working machine is equal to the weight of a front work device of a single arm working machine belonging to the same class as the dual arm working machine. The single arm working machine belonging to the same class as the dual arm working machine means the single arm working machine having the same engine power as that of the dual arm working machine. The dual arm working machine can maintain stability (static balance) that is the same as that of the single arm working machine belonging to the same class as the dual arm working machine.

Engine power required to operate a front work device is in a nearly proportional relationship to the intensity of the front work device, and the intensity of the front work device is in a nearly proportional relationship to the weight of the front work device. Therefore, engine power required to operate each of the two front work devices of the dual arm working machine is in a nearly proportional relationship to the total weight of the front work devices, and nearly equal to the half of engine power required to operate the front work device of the single arm working machine belonging to the same class as the dual arm working machine. The engine power required to operate each of the two front work devices of the dual arm working machine is not necessarily sufficient, and has been needed to be increased.

In order to increase the engine power required to operate each of the two front work devices, however, it is unavoidable to increase the total weight of the two front work devices. It has been difficult to increase the engine power required to operate the two front work devices while the stability of the operations is still ensured.

The present invention has been made in view of the above circumstance. It is, therefore, an object of the present invention to provide a dual arm working machine capable of suppressing a reduction in stability due to an increase in engine power required to operate each of two front work devices.

Means for Solving the Problems (1) To accomplish the object, the dual arm working machine includes a lower travel structure having a travel device, an upper swing structure that is provided above the lower travel structure and has a cab, two front work devices that are provided swingably in top-bottom and left-right directions of the dual arm working machine, and are located on the right and left sides of a front portion of the upper swing structure, and have arms, booms and working devices, respectively, and operating devices that are provided in the cab and instruct the two front work devices to operate, the dual arm working machine comprises: arm angle detectors that detect angles of the arms relative to the booms of the two front work devices, respectively; control part displacement detectors that detect operating directions of the operating devices and the amounts of operations of the operating devices; and an operating range calculator that calculates drive signals for the arms based on detection signals received from the arm angle detectors and on detection signals received from the control part displacement detectors and the arm angle detectors; wherein when a value used to evaluate and determine stability of the dual arm working machine is defined as a stability determination value, the stability changing depending on the positions of the front work devices, and when a range of the stability determination value, in which the dual arm working machine does not come to be in an unstable state regardless of the states of the operations of the two front work devices, is defined as a normal range, a range of the stability determination value, which is present on an outer side of the normal range and adjacent to the normal range, is defined as a stable state limit range, and a range of the stability determination value, which is present on an outer side of the stable state limit range and adjacent to the stable state limit range and in which the stability determination value is larger than a predetermined stability determination standard value, is defined as an unstable range, the operating range calculator calculates the stability determination value based on the arm angles detected by the arm angle detectors of the two front work devices; and when the stability determination value is in the stable state limit range and approaches the unstable range, the operating range calculator reduces values of the drive signals compared with values of the drive signals calculated when the stability determination value is in the normal range, and outputs the reduced drive signals to limit operating speeds of the arms.

When the dual arm working machine is configured to ensure that the total weight of the two front work devices of the dual arm working machine is the same as the weight of a front work device of a single arm working machine (having the same engine power as that of the dual arm working machine) belonging to the same class as the dual arm working machine, stability (static balance) of the dual arm working machine is the same as that of the single arm working machine belonging to the same class as the dual arm working machine. Engine power required to operate a front work device is in a nearly proportional relationship to the intensity of the front work device, and the intensity of the front work device is in a nearly proportional relationship to the weight of the front work device. When engine power required to operate the two front work devices of the dual arm working machine is increased, it is necessary to increase the total weight of the two front work devices of the dual arm working machine. This may reduce stability of the dual arm working machine as compared with stability of the single arm working machine belonging to the same class as the dual arm working machine. According to the present invention, the range of the stability determination value, in which the dual arm working machine does not become unstable regardless of the states of the operations of the two front work devices, is defined as the normal range; the range of the stability determination value, which is present on the outer side of the normal range and adjacent to the normal range, is defined as the stable state limit range; and the range of the stability determination value, which is present on the outer side of the stable state limit range and adjacent to the stable state limit range and in which the stability determination value is larger than the predetermined stability determination standard value, is defined as the unstable range. The stability determination value is calculated based on the arm angles detected by the arm angle detectors of the two front work devices. When the stability determination value is in the stable state limit range, the values of the drive signals are reduced to reduce the operating speeds of the arms. Since the stable state limit range is set in consideration of the stability of the single arm working machine belonging to the same class as the dual arm working machine, it is possible to ensure the same stability of the dual arm working machine as the stability of the single arm working machine belonging to the same class as the dual arm working machine, and suppress a reduction in the stability due to the increase in the engine power required to operate the two front work devices.

(2) The dual arm working machine described in item (1) preferably further comprises boom angle detectors that detect angles of the booms of the two front work devices relative to the upper swing structure, wherein the operating range calculator calculates drive signals for the booms and the arms based on detection signals received from the control part displacement detectors, detection signals received from the boom angle detectors and detection signals received from the arm angle detectors, and calculates the stability determination value based on the arm angles detected by the arm angle detectors of the two front work devices and on the boom angles detected by the boom angle detectors of the two front work devices, and when the stability determination value is in the stable state limit range and approaches the unstable range, the operating range calculator reduces the values of the drive signals compared with the values of the drive signals calculated when the stability determination value is in the normal range, and outputs the reduced drive signals to limit the operating speeds of the arms and the operating speeds of the booms.

(3) In the dual arm working machine described in item (1), it is preferable that the stability determination value be calculated based on the average of the angles of the arms of the two front work devices.

This makes it possible to maximize an operating range of one of the two front work devices when an operating range of the other of the two front work devices is minimized, and thereby efficiently perform the operations of the two front work devices.

(4) In the dual arm working machine described in item (2), it is preferable that the stability determination value be calculated based on the average of distances between arm ends of the arms of the two front work devices and the upper swing structure, the distances being calculated based on the angles of the booms of the front work devices and on the angles of the arms of the front work devices.

This makes it possible to maximize the operating range of one of the two front work devices when the angle of the arm of the other of the two front work devices is minimized.

(5) In the dual arm working machine described in any of items (1) to (4), when the stability determination value is in the stable state limit range and approaches the unstable range, the operating range calculator preferably increases the rate of a reduction in the values of the drive signals in a continuous or stepwise manner as the stability determination value approaches the unstable range.

This makes it possible to smoothly stop the operations of the front work devices.

(6) In the dual arm working machine described in any of items (1) to (4), when the stability determination value is in the unstable range and moves away from the stable state limit range, the operating range calculator preferably stops outputting the drive signals to stop operations of the arms.

(7) In the dual arm working machine described in any of items (1) to (6), engine power required to operate the two front work devices is preferably larger than engine power required to operate a front work device of a single arm working machine having the same engine power as that of the dual arm working machine.

(8) In the dual arm working machine described in item (1), the stability determination standard value is preferably equal to the stability determination value obtained when the total of static moments of the two front work devices is equal to the maximum value of a static moment of a front work device of a single arm working machine having the same engine power as that of the dual arm working machine.

Effect of the Invention

According to the present invention, it is possible to suppress the reduction in the stability due to the increase in the engine power required to operate the two front work devices.

BRIEF DESCRIPTION OF THE DRAWINGS

FIG. 4 is a functional block diagram of a control system for first and second front work devices.

FIG. 15 is a functional block diagram of a control system for first and second front work devices according to a second embodiment of the present invention.

DESCRIPTION OF REFERENCE NUMERALS AND SYMBOLS

Figure 1:
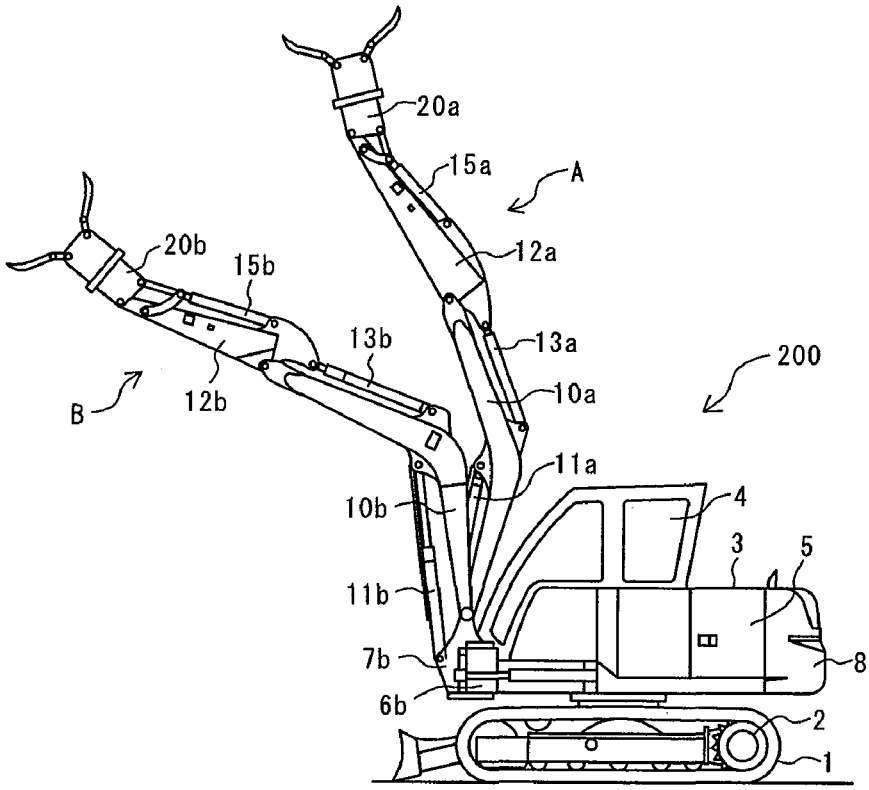
FIG. 1 is a side view of the appearance of a dual arm hydraulic excavator that is an example of a dual arm working machine according to a first embodiment of the present invention.

A First front work device
B Second front work device
200 Dual arm hydraulic excavator
1 Track body
2 Lower travel structure
3 Upper swing structure
3*a* Rotational axis
3*c* Dividing line
4 Cab
5 Hatch
6*a* First bracket
6*b* Second bracket
7*a*, 7*b* Swing post
8 Rear portion of Upper Swing Structure
9*a*, 9*b* Swing post cylinder
10*a*, 10*b* Boom
11*a*, 11*b* Boom cylinder
12*a*, 12*b* Arm
13*a*, 13*b* Arm cylinder
15*a*, 15*b* Working device cylinder
20*a*, 20*b* Working device
49 Operator seat
50*a*, 50*b* Operating device
51*a*, 51*b* Control arm bracket
52*a*, 52*b* Control arm
53*a*, 53*b* Arm rest
54*a*, 54*b* Control lever
55*a*, 55*b* Working device pivot lever
56*a*, 56*b* Working device control switch
57*a*, 57*b* Control arm displacement detector
581*a*, 581*b* Control lever top-bottom direction displacement detector
582*a*, 582*b* Control lever front-back direction displacement detector
59*a*, 59*b* Working device pivot lever displacement detector
60*a*, 60*b* Working device control switch displacement detector
61, 261, 361 Control unit
61A to 61E Drive signal generator
61F, 261F, 361F Operating range calculator
64*a*, 64*b* Arm cylinder drive system
63*a*, 63*b* Boom cylinder drive system
62*a*, 62*b* Swing post cylinder drive system
65*a*, 65*b* Working device cylinder drive system
66*a*, 66*b* Working device drive system
69*a*, 69*b* Arm angle detector
71*a*, 71*b* Arm end
73*a*, 73*b* Swinging axis
74*a*, 74*b* Pivot axis
75*a*, 75*b* Swinging axis ($2^{nd}$)
77*a*, 77*b* Elbow joint holder
78*a*, 78*b* Elbow joint position adjuster
110 Operating range calculator switch
130 Standard coordinates
130*a* Original point of standard coordinates
L Normal range
M Stable state limit range
N Unstable range
P1*a*, P1*b* Barycentric coordinates of boom
P2*a*, P2*b* Barycentric coordinates of arm
P3*a*, P3*b* Barycentric coordinates of working device
θa, θb Arm angle
θc Average arm angle
θc1, θc2 Threshold value
Xa, Xb Arm horizontal coordinate
Xc Average arm horizontal coordinate
Xc1, Xc2 Threshold value
Ta, Tb Static moment
Tc Average of static moments
Tc1, Tc2 Threshold value

BEST MODE FOR CARRYING OUT THE INVENTION

Embodiments of the present invention are described below with reference to the accompanying drawings.

The first embodiment of the present invention is described with reference to FIGS. 1 to 14.

Figure 2:
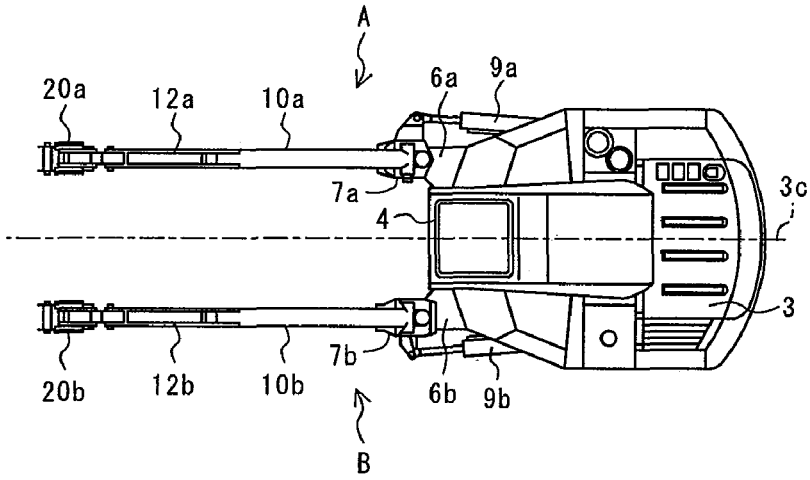
FIG. 2 is a top view of the appearance of the dual arm hydraulic excavator that is the example of the dual arm working machine according to the first embodiment of the present invention.

FIGS. 1 and 2 are diagrams each showing the appearance of a dual arm hydraulic excavator 200 that is an example of a dual arm working machine according to the first embodiment of the present invention. FIG. 1 is a side view of the dual arm hydraulic excavator 200. FIG. 2 is a top view of the dual arm hydraulic excavator 200 showing dividing line 3*c*.

In FIGS. 1 and 2, the dual arm hydraulic excavator 200 has a lower travel structure 2, an upper swing structure 3, a cab 4, a first front work device A and a second front work device B. The lower travel structure 2 has a track body 1. The upper swing structure 3 can rotate above the lower travel structure 2 and includes a hatch and rear portion 8. The cab 4 is provided at a central front portion of the upper swing structure 3. The first and second front work devices A and B are provided swingably in top-bottom and left-right directions of the dual arm working machine. The first and second front work devices A and B are located on the right and left sides of a front portion of the upper swing structure 3.

The first front work device A has a first bracket 6*a*, a swing post 7*a*, a boom 10*a*, an arm 12*a*, a working device 20*a* (grapple in FIGS. 1 and 2), a swing post cylinder 9*a*, a boom cylinder 11*a*, an arm cylinder 13*a* and a working device cylinder 15*a*. The first bracket 6*a* is provided on the right front side of the upper swing structure 3. The swing post 7*a* is attached to the first bracket 6*a* and swingable around a vertical axis in the left-right direction. The boom 10*a* is attached to the swing post 7*a* and swingable in the top-bottom direction. The arm 12*a* is attached to the boom 10*a* and swingable in the top-bottom direction. The working device 20*a* is attached to the arm 12*a* and pivotable in the top-bottom direction. The swing post cylinder 9*a* is coupled to the swing post 7*a* and the upper swing structure 3 and swings the swing post 7*a* around the vertical axis in the left-right direction. The boom cylinder 11*a* is coupled to the swing post 7*a* and the boom 10*a* and swings the boom 10*a* in the top-bottom direction. The arm cylinder 13*a* is coupled to the boom 10*a* and the arm 12*a* and swings the arm 12*a* in the top-bottom direction. The working device cylinder 15*a* is coupled to the arm 12*a* and the working device 20*a* and causes the working device 20*a* to pivot in the top-bottom direction.

In addition to the grapple shown in FIGS. 1 and 2, the working device 20*a* may be replaced with any one of a cutter, a breaker, a bucket and another working device, depending on the work of the working machine.

The second front work device B is provided on the left front side of the upper swing structure 3. The second front work device B is configured in the same manner as the first front work device A. The same elements of the second front work device B as those of the first front work device A are indicated by the same numbers with symbols "b" changed from the symbols "a", and description thereof is omitted.

Operating devices 50*a* and 50*b* (shown in FIG. 3) are installed in the cab 4 of the hydraulic excavator 200 and adapted to operate the first and second front work device A and B, respectively. An operating range calculator switch 110 (shown in FIG. 4) is provided in the cab 4 of the hydraulic excavator 200 and adapted to switch an operating range calculation (described later) between an active mode and an inactive mode.

Figure 3:
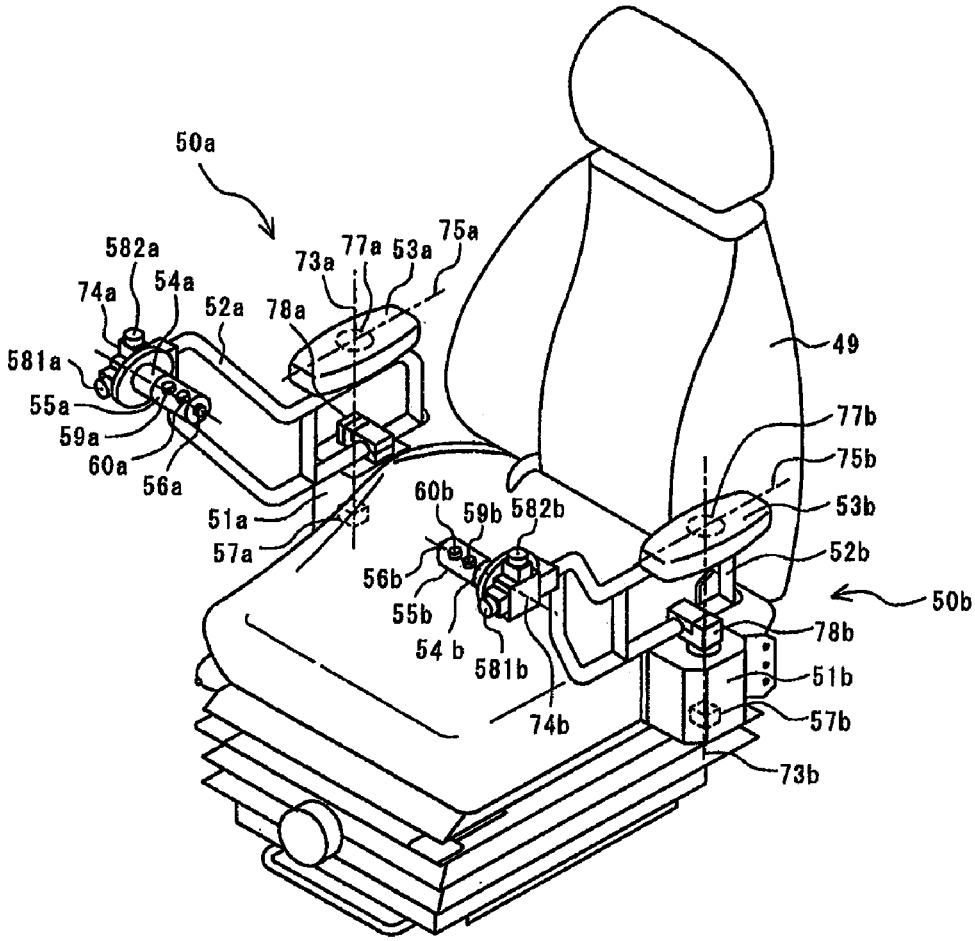
FIG. 3 is a perspective view of operating devices provided in a cab.

FIG. 3 is a perspective view of the operating devices 50*a* and 50*b* and an operator seat 49, which are provided in the cab 4.

The operating device 50*a* provided for the first front work device A and the operating device 50*b* provided for the second front work device B are installed on the right and left sides of the operator seat 49.

The operating device 50*a* has a control arm bracket 51*a*, a control arm 52*a* and an arm rest 53*a*. The control arm bracket 51*a* is provided on the right side of the operator seat 49. The control arm 52*a* is attached to the control arm bracket 51*a* and swingable around a swinging axis 73*a* in the left-right direction to instruct the first front work device A to perform the left-right directional swinging. The arm rest 53*a* is attached to the control arm 52*a* and swingable with the control arm 52*a*. The arm rest 53*a* has an elbow joint holder 77*a* on which an elbow joint of the operator is placed. The control arm 52*a* and the arm rest 53*a* are attached to the control arm bracket 51*a* to ensure that the elbow joint holder 77*a* of the arm rest 53*a* is located on the swinging axes 73*a*, 75*a* of the control arm 52*a*. The control arm bracket 51*a* has an elbow joint position adjuster 78*a*. The elbow joint position adjuster 78*a* is adapted to adjust the position of the elbow joint holder 77*a* based on the shape of the operator.

The operating device 50*a* also has a control lever 54*a*, a working device pivot lever 55*a*, and a working device control switch 56*a*. The control lever 54*a* is attached to an edge portion of the control arm 52*a* and pivotable in the top-bottom direction and in a front-back direction of the dual arm working machine. The control lever 54*a* is adapted to instruct the boom 10*a* and arm 12*a* of the first front work device A to operate. The control lever 54*a* extends in the left-right direction. The working device pivot lever 55*a* is attached to a circumferential portion of the control lever 54*a* and pivotable around a pivot axis 74*a* of the control lever 54*a*. The working device pivot lever 55*a* is adapted to instruct the working device 20*a* to pivot. The working device control switch 56*a* is attached to an edge portion of the control lever 54*a* and adapted to instruct the working device 20*a* to start and stop an operation.

The operating device 50*a* has a control arm displacement detector 57*a*, a control lever top-bottom direction displacement detector 581*a*, a control lever front-back direction displacement detector 582*a*, a working device pivot lever displacement detector 59*a* and a working device control switch displacement detector 60*a*. The control arm displacement detector 57*a* is provided at the control arm bracket 51*a*. The control arm displacement detector 57*a* detects the amount of displacement (due to the swing of the control arm 52*a*) of the control arm 52*a* and transmits a signal (control signal). The control lever top-bottom direction displacement detector 581*a* is provided at the control arm 52*a*. The control lever top-bottom direction displacement detector 581*a* detects the amount of displacement (in the top-bottom direction) of the control lever 54*a* and transmits a control signal. The control lever front-back direction displacement detector 582*a* detects the amount of displacement (in the front-back direction) of the control lever 54*a* and transmits a control signal. The working device pivot lever displacement detector 59*a* is provided at the control lever 54*a*. The working device pivot lever displacement detector 59*a* detects the amount of a rotation of the working device pivot lever 55*a* and transmits a control signal. The working device control switch displacement detector 60*a* is provided at the working device pivot lever 55*a*. The working device control switch displacement detector 60*a* detects the amount of displacement of the working device control switch 56*a* and transmits a control signal.

The operating device 50*b* is provided on the left side of the operator seat 49. The operating device 50*b* is configured in the same manner as the operating device 50*a*. The same elements of the operating device 50*b* as those of operating device 50*a* are indicated by the same numbers with symbols "b" changed from the symbols "a", and description thereof is omitted.

FIG. 4 is a functional block diagram showing a control system for the first and second front work devices A and B. Symbols represented in parentheses shown in FIG. 4 indicate displacement detectors, angle detectors and drive systems for the second front work device B.

The control system shown in FIG. 4 includes the displacement detectors (provided in the operating devices 50*a* and 50*b* installed in the cab 4), an operating range calculator switch 110, an input system, a control unit 61, and an output system. The input system is composed of angle detectors (described later) provided at the first and second front work devices A and B. The control unit 61 performs a predetermined calculation based on signals (control signal, command signal, and detection signal) received from the input system to generate and output drive signals. The output system receives the drive signals from the control unit 61. The output system includes drive systems (described later) that operate the portions of the first and second front work devices A and B based on the received drive signals.

The input system for the control unit 61 includes the control arm displacement detectors 57*a* and 57*b*, the control lever top-bottom direction displacement detectors 581*a* and 581*b*, the control lever front-back direction displacement detectors 582*a* and 582*b*, the working device pivot lever displacement detectors 59*a* and 59*b*, the working device control switch displacement detectors 60*a* and 60*b*, the operating range calculator switch 110, and arm angle detectors 69*a* and 69*b*. The control arm displacement detectors 57*a* and 57*b* detect the amounts of displacement (due to the swings of the control arms 52*a* and 52*b*) of the control arms 52*a* and 52*b* and transmit signals (control signals), respectively. The control lever top-bottom direction displacement detectors 581*a* and 581*b* detect the amounts of displacement (in the top-bottom direction) of the control levers 54*a* and 54*b* and transmit control signals, respectively. The control lever front-back direction displacement detectors 582*a* and 582*b* detect the amounts of displacement (in the front-back direction) of the control levers 54*a* and 54*b* and transmit control signals, respectively. The working device pivot lever displacement detectors 59*a* and 59*b* detect the amounts of the rotations of the working device pivot lever 55*a* and 55*b* and transmit control signals, respectively. The working device control switch displacement detectors 60*a* and 60*b* detect the amounts of displacement of the working device control switch 56*a* and 56*b* and transmit control signals, respectively. The operating range calculator switch 110 transmits a signal (command signal) to switch the operating range calculation (described later) between the active mode and the inactive mode. The arm angle detectors 69*a* and 69*b* detect angles of the arms 12*a* and 12*b* (of the first and second front work devices A and B) and transmit signals (detection signals), respectively.

The output system for the control unit 61 includes swing post cylinder drive systems 62*a* and 62*b*, boom cylinder drive systems 63*a* and 63*b*, arm cylinder drive systems 64*a* and 64*b*, working device cylinder drive systems 65*a* and 65*b*, and working device drive systems 66*a* and 66*b*. The swing post cylinder drive systems 62*a* and 62*b* drive the swing post cylinders 9*a* and 9*b*, respectively. The boom cylinder drive systems 63*a* and 63*b* drive the boom cylinders 11*a* and 11*b*, respectively. The arm cylinder drive systems 64*a* and 64*b* drive the arm cylinders 13*a* and 13*b*, respectively. The working device cylinder drive systems 65*a* and 65*b* drive the working device cylinders 15*a* and 15*b*, respectively. The working device drive systems 66*a* and 66*b* drive the working devices 20*a* and 20*b*, respectively.

The control unit 61 includes an operating range calculator 61F, and drive signal generators 61A, 61B, 61C, 61D and 61E. The operating range calculator 61F calculates an operating range based on signals (control signals) received from the operating range calculator switch 110, the arm angle detectors 69*a* and 69*b* and the control lever front-back direction displacement detectors 582*a* and 582*b*. The drive signal generator 61C generates drive signals (to be transmitted to the arm cylinder drive systems 64*a* and 64*b*) based on a signal (calculation result) received from the operating range calculator 61F. The drive signal generator 61A generates drive signals (to be transmitted to the swing post cylinder drive systems 62*a* and 62*b*) based on signals received from the control arm displacement detectors 57*a* and 57*b*. The drive signal generator 61B generates drive signals (to be transmitted to boom cylinder drive systems 63*a* and 63*b*) based on signals received from the control lever top-bottom direction displacement detectors 581*a* and 581*b*. The drive signal generator 61D generates drive signals (to be transmitted to the working device cylinder drive systems 65*a* and 65*b*) based on signals received from the working device pivot lever displacement detectors 59*a* and 59*b*. The drive signal generator 61E generates drive signals (to be transmitted to the working device drive systems 66*a* and 66*b*) based on signals received from the working device control switch displacement detectors 60*a* and 60*b*.

Figure 5:
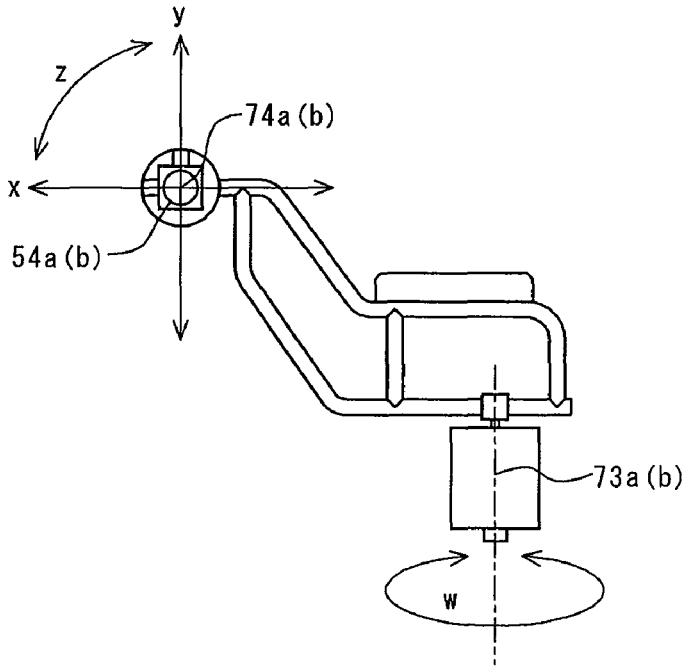
FIG. 5 is a diagram showing operating directions of the operating devices.
Figure 6:
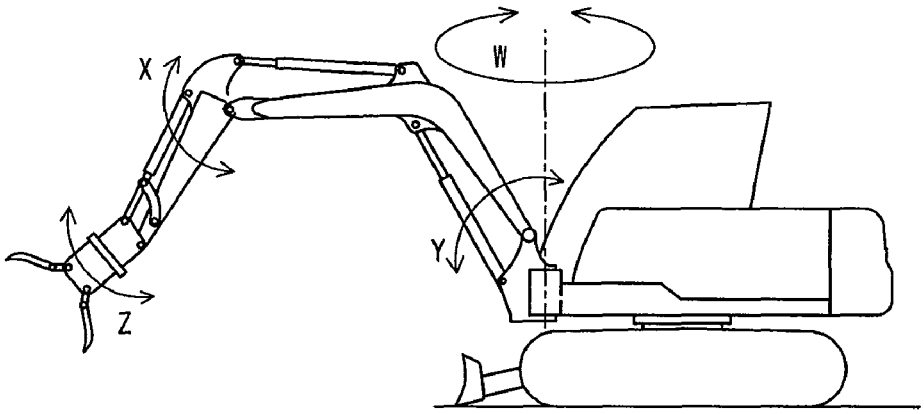
FIG. 6 is a diagram showing operations of the first and second front work devices based on the operating directions of the operating devices.

Next, operations of the operating devices 50*a* and 50*b* and operations of the first and second front work devices A and B are described below with reference to FIGS. 5 and 6. FIG. 5 is a diagram showing operating directions of the operating devices 50*a* and 50*b*. FIG. 6 is a diagram showing the operations of the first and second front work devices A and B based on the operating directions of the operating devices 50*a* and 50*b*. It should be noted that the parts (shown in FIG. 5) for the second front work device B are indicated by symbols "b" represented in parentheses shown in FIG. 5.

In order to operate the operating devices 50*a* and 50*b* and thereby operate the first and second front work devices A and B, an operator sits on the operator seat 49, puts his/her right elbow joint on the elbow joint holder 77*a* of the arm rest 53*a* provided on the control arm 52*a*, holds the working device pivot lever 55*a* with his/her right hand, and puts his/her thumb on the working device control switch 56*a*. Similarly, the operator puts his/her left elbow joint on the elbow joint holder 77*b* of the arm rest 53*b* provided on the control arm 52*b*, holds the working device pivot lever 55*b* with his/her left hand, and puts his/her thumb on the working device control switch 56*b*.

Under this condition, the operator swings the control arms 52*a* and 52*b* of the operating devices 50*a* and 50*b* with his/her forearms in the left-right direction (refer to "w" shown in FIG. 5). The control arm displacement detectors 57*a* and 57*b* then transmit control signals to the drive signal generator 61A of the control unit 61 for the swing post cylinder drive systems 62*a* and 62*b*, respectively. The drive signal generator 61A receives the control signals from the control arm displacement detectors 57*a* and 57*b*, and transmits drive signals to the swing post cylinder drive systems 62*a* and 62*b*. The swing post cylinder drive systems 62*a* and 62*b* receive the drive signals from the drive signal generator 61A, and cause the swing post cylinders 9*a* and 9*b* to extend and shrink, respectively. These operations cause the swing posts 7*a* and 7*b* to swing in the same directions as directions of displacement of the control arms 52*a* and 52*b*, respectively (refer to "W" shown in FIG. 6).

In this case, the swing speeds of the swing posts 7*a* and 7*b* monotonically (e.g., proportionally) increase as the amounts of displacement of the control arms 52*a* and 52*b* increase. The control arms 52*a* and 52*b* are displaced to control the swing speeds of the swing posts 7*a* and 7*b*.

When the operator uses his/her hands to displace the control levers 54*a* and 54*b* in the top-bottom direction (refer to "y" shown in FIG. 5), the control lever top-bottom direction displacement detectors 581*a* and 581*b* transmit control signals to the drive signal generator 61B for the boom cylinder drive systems 63*a* and 63*b* of the control unit 61. The drive signal generator 61B receives the control signals from the control lever top-bottom direction displacement detectors 581*a* and 581*b*, and transmits drive signals to the boom cylinder drive systems 63*a* and 63*b*. The boom cylinder drive systems 63*a* and 63*b* receive the drive signals from the drive signal generator 61B, and cause the boom cylinders 11*a* and lib to extend and shrink, respectively. The extension and shrinkage of the boom cylinders 11*a* and 11*b* cause the booms 10*a* and 10*b* to swing (refer to "Y" shown in FIG. 6).

The swing speeds of the booms 10*a* and 10*b* monotonically (e.g., proportionally) increase as the amounts of displacement (in the top-bottom direction (y direction)) of the control levers 54*a* and 54*b* increase. The control levers 54*a* and 54*b* are displaced in the top-bottom direction to control the swing speeds of the booms 10*a* and 10*b*.

Similarly, when the operator uses his/her hands to displace the control levers 54*a* and 54*b* in the front-back direction (refer to "x" shown in FIG. 5), the control lever front-back direction displacement detectors 582*a* and 582*b* and the arm angle detectors 69*a* and 69*b* transmit control signals to the operating range calculator 61F provided in the control unit 61. The operating range calculator 61F receives the control signals from the control lever front-back direction displacement detectors 582*a* and 582*b* and the arm angle detectors 69*a* and 69*b*. The operating range calculator 61F calculates an operating range based on the control signals transmitted by the control lever front-back direction displacement detectors 582*a* and 582*b* and the arm angle detectors 69*a* and 69*b*, when the mode of the operating range calculation is switched to the active mode by a command signal transmitted by the operating range calculator switch 110. Then, the operating range calculator 61F transmits a signal (calculation result) to the drive signal generator 61C for the arm cylinder drive systems 64*a* and 64*b*. The drive signal generator 61C receives the signal from the operating range calculator 61F, and transmits drive signals to the arm cylinder drive systems 64*a* and 64*b*. The arm cylinder drive systems 64*a* and 64*b* receive the drive signals and cause the arm cylinders 13*a* and 13*b* to extend and shrink. The extension and shrinkage of the arm cylinders 13*a* and 13*b* cause the arms 12*a* and 12*b* to swing (refer to "X" shown in FIG. 6).

When the mode of the operating range calculation is switched to the inactive mode by a command signal transmitted by the operating range calculator switch 110, the operating range calculator 61F does not perform the operating range calculation, and transmits, to the drive signal generator 61C, the control signals transmitted by the control lever front-back direction displacement detectors 582*a* and 582*b*, without changing the control signals. The drive signal generator 61C receives the control signals from the operating range calculator 61F, and then transmits drive signals to the arm cylinder drive systems 64*a* and 64*b*. The arm cylinder drive systems 64*a* and 64*b* receive the drive signals and then cause the arm cylinders 13*a* and 13*b* to extend and shrink. The extension and shrinkage of the arm cylinders 13*a* and 13*b* cause the arms 12*a* and 12*b* to swing (refer to "X" shown in FIG. 6). In this case, the swing speeds of the arms 12*a* and 12*b* monotonically (e.g., proportionally) increase as the amounts of displacement (in the front-back direction (x direction)) of the control levers 54*a* and 54*b* increase. The control levers 54*a* and 54*b* are displaced in the front-back direction to control the swing speeds of the arms 12*a* and 12*b*.

When the operators uses his/her hands to cause the working device pivot levers 55*a* and 55*b* to pivot around the pivot axes 74*a* and 74*b* (refer to "z" shown in FIG. 5), the working device pivot lever displacement detectors 59*a* and 59*b* transmit control signals to the drive signal generator 61D for the working device cylinder drive systems 65*a* and 65*b* of the control unit 61. The drive signal generator 61D receives the control signals from the working device pivot lever displacement detectors 59*a* and 59*b*, and then transmits drive signals to the working device cylinder drive systems 65*a* and 65*b*. The working device cylinder drive systems 65*a* and 65*b* receive the drive signals from the drive signal generator 61D, and then cause the working device cylinders 15*a* and 15*b* to extend and shrink, respectively. The extension and shrinkage of the working device cylinders 15*a* and 15*b* cause the working devices 20*a* and 20*b* to swing (refer to "Z" shown in FIG. 6).

In this case, the swing speeds of the working devices 20*a* and 20*b* monotonically (e.g., proportionally) increase as the amounts of displacement of the working device pivot levers 55*a* and 55*b* increase. The working device pivot levers 55*a* and 55*b* are displaced to control the swing speeds of the working devices 20*a* and 20*b*.

When the operator uses his/her fingers to displace the working device control switches 56*a* and 56*b*, the working device control switch displacement detectors 60*a* and 60*b* transmit control signals to the drive signal generator 61E for the working device drive systems 66*a* and 66*b* of the control unit 61. The drive signal generator 61E receives the control signals from the working device control switch displacement detectors 60*a* and 60*b*, and then transmits drive signals to the working device drive systems 66*a* and 66*b*. The working device drive systems 66*a* and 66*b* receive the drive signals from the drive signal generator 61E, and then drive the working devices 20*a* and 20*b*, respectively. When the grapples shown in FIG. 1 are used as the working devices 20*a* and 20*b*, the grapples are opened and closed in response to the operations of the working device control switches 56*a* and 56*b*.

In this case, the opening/closing speeds of the grapples (working devices 20*a* and 20*b*) monotonically (e.g., proportionally) increase as the amounts of displacement of the working device control switches 56*a* and 56*b* increase. The working device control switches 56*a* and 56*b* are displaced to control the opening/closing speeds of the working devices 20*a* and 20*b*.

Next, contents of the operating range calculation performed by the operating range calculator 61F of the control unit 61 are described below with reference to FIGS. 7 to 14.

Figure 7:
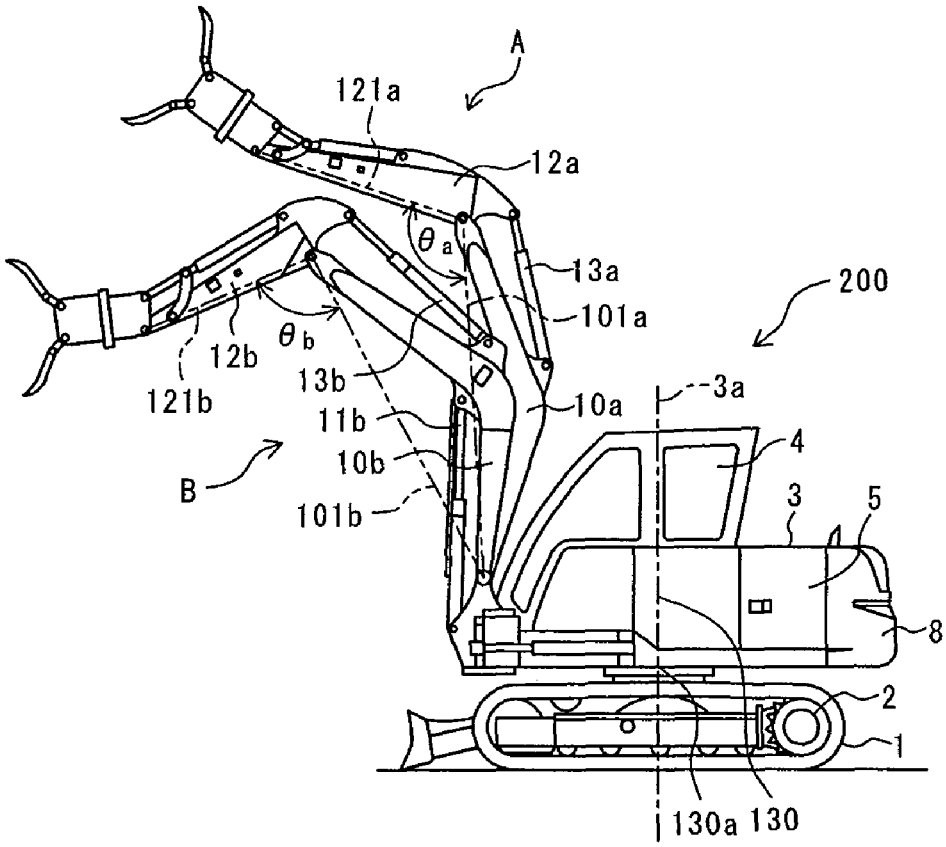
FIG. 7 is a diagram showing angles of arms of the first and second front work devices.

FIG. 7 is a diagram showing angles of the arms of the first and second front work devices A and B.

As shown in FIG. 7, an angle (arm angle) formed between the boom 10*a* and arm 12*a* of the first front work device A is indicated by θa, and an angle (arm angle) formed between the boom 10*b* and arm 12*b* of the second front work device B is indicated by θb. The average (average arm angle) of the arm angles θa and θb is indicated by θc (=(θa+θb)/2). In this case, the arm angles θa and θb of the first and second front work devices A and B are set in the same manner. In the present embodiment, a line passing both ends (a connection point between the boom 10*a* and the swing post 7*a*, and a connection point between the boom 10*a* and the arm 12*a*) of the boom 10*a* of the first front work device A is defined as a standard boom line 101*a*. A line passing both ends (a connection point between the arm 12*a* and the boom 10*a*, and a connection point between the arm 12*a* and the working device 20*a*) of the arm 12*a* of the first front work device A is defined as a standard arm line 121*a*. An angle formed between the standard boom line 101*a* and the standard arm line 121*a* is defined as an arm angle θa. A direction extending from an inner side of the arm 12*a* to an outer side of the arm 12*a* is defined as a positive direction in terms of the arm angle θa. In other words, when the arm 12*a* is driven and moved toward a dump area, the arm angle θa increases. The arm angle θb is defined in the same manner as the arm angle θa. That is, a line passing both ends of the boom 10*b* of the second front work device B is defined as a standard boom line 101*b*. A line passing both ends of the arm 12*b* is defined as a standard arm line 121*b*. An angle formed between the standard boom line 101*b* and the standard arm line 121*b* is defined as an arm angle θb. A direction extending from an inner side of the arm 12*b* to an outer side of the arm 12*b* is defined as a positive direction in terms of the arm angle θb.

Figure 8:
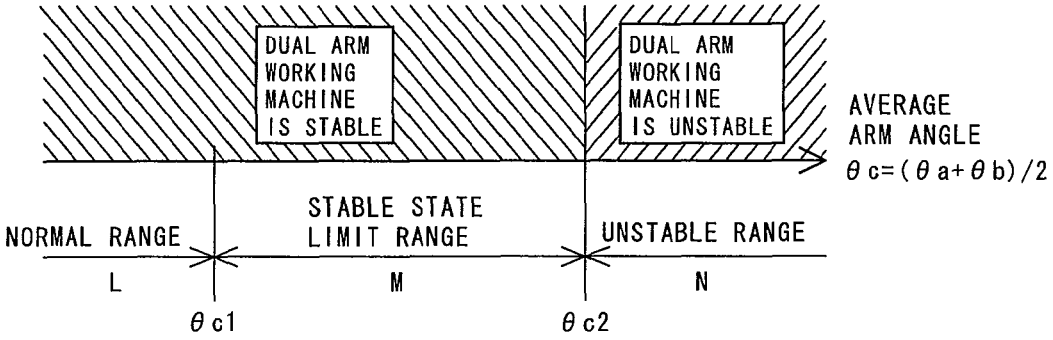
FIG. 8 is a conceptual diagram showing the relationship between an average arm angle and stability of the dual arm working machine.

FIG. 8 is a conceptual diagram showing the relationship between the average arm angle θc and stability of the dual arm working machine.

In FIG. 8, the average arm angle θc is plotted along an abscissa axis. The state where the average arm angle θc is lower than a threshold value θc2 is defined as a stable state of the dual arm hydraulic excavator 200 (the dual arm working machine is in the stable state). The state where the average arm angle θc is larger than the threshold value θc2 is defined as an unstable state of the dual arm hydraulic excavator 200 (the dual arm working machine is in the unstable state). A method for defining the threshold value θc2 is not limited. For example, the threshold value θc2 may be equal to (or lower than) the average arm angle θc obtained when the stability (static balance) of the dual arm working machine (dual arm hydraulic excavator 200) according to the present embodiment is the same as that of a single arm working machine belonging to the same class as the dual arm working machine and extending its front work device forward to the maximum extent. A single arm working machine belonging to the same class as the dual arm working machine means a single arm working machine having the same engine power as that of the dual arm working machine or having engine power close to that of the dual arm working machine. The operating range calculator 61F has the threshold value θc2 stored therein. A range of the average arm angle θc, in which the average arm angle θc is equal to or larger than the threshold value θc2 and the dual arm hydraulic excavator 200 is in the unstable state, is defined as an unstable range N.

On the other hand, when the average arm angle θc is lower than the threshold value θc2, and each of the front work devices A and B is in a stop state, the dual arm working machine does not become unstable. However, it may be difficult to rapidly stop the operations of the front work devices A and B when the average arm angle θc is lower than the threshold value θc2. Even when the front work devices A and B operate under the condition that the dual arm working machine is in the stable state, the front work devices A and B may operate under the condition that the average arm angle θc is close to the unstable range N and the average arm angle θc may increase. In such a case, the average arm angle θc may lie in the unstable range N and the dual arm working machine may become unstable depending on the operating speeds of the front work devices A and B. To avoid this, a threshold value θc1 (<θc2) is set in a range which is adjacent to the unstable range N in consideration of a margin to reduce the operating speeds of the front work devices A and B and stop the operations of the front work devices A and B before the dual arm working machine becomes unstable. The operating range calculator 61F has the threshold value θc1 stored therein. A range of the average arm angle, in which the average arm angle θc is equal to or larger than the threshold value θc1 and smaller than the threshold value θc2 and which is adjacent to the unstable range N, is defined as a stable state limit range M.

A range of the average arm angle, in which the average arm angle θc is smaller than the threshold value θc1 and the dual arm working machine does not become unstable regardless of the states of the operations of the front work devices A and B and which is adjacent to the stable state limit range M, is defined as a normal range L.

The average arm angle θc is a stability determination value used to evaluate and determine the stability (changing depending on the positions of the front work devices A and B) of the dual arm working machine, while the threshold value θc2 is a stability determination standard value.

Figure 9:
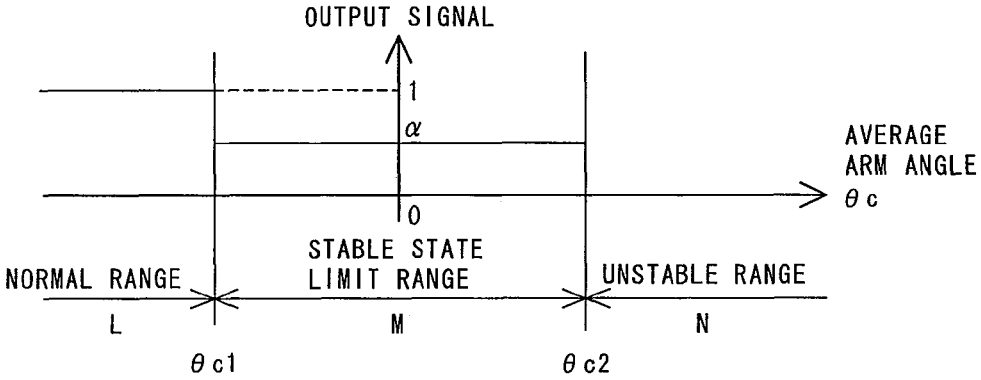
FIG. 9 is a diagram showing an example of the relationship between the average arm angle and the magnitudes of signals output by an operating range calculator.

FIG. 9 is a diagram showing an example of the relationship between the average arm angle θc and the magnitudes of signals (calculation results) output by the operating range calculator 61F when the operating range calculation to be performed by the operating range calculator 61F is in the active mode and the average arm angle θc of the arm angles of the first and second front work devices A and B increases.

In FIG. 9, the average arm angle θc is plotted along an abscissa axis, and a ratio of the output signal to an input signal is plotted along an ordinate axis. The output signal is divided by the input signal to be dimensionless. In the example shown in FIG. 9, when the average arm angle θc is in the normal range L, the output signal indicates "1", and the input signal is output as the output signal (calculation result). When the average arm angle θc is in the stable stage threshold range M, the output signal has a value $\alpha(0<\alpha<1)$. In this case, the operating range calculator 61F multiplies the input signal by the value α to reduce the value of the input signal and thereby obtain a signal to be output. Then, the operating range calculator 61F outputs the obtained signal as the output signal (calculation result) having the value α. When the average arm angle θc is in the unstable range N, the output signal is zero. In this case, the operating range calculator 61F multiplies the input signal by zero to obtain a signal. The obtained signal is the calculation result. That is, the signal is not output.

Next, a description will be made of procedures for performing the operating range calculation by means of the operating range calculator 61F to calculate a signal to be output.

(1) Normal range L

When the average arm angle θc of the arm angles of the first and second front work devices A and B is in the normal range L, i.e., is on the outer side of the stable state limit range M, the operating range calculator 61F outputs the signals received from the control lever front-back direction displacement detectors 582*a* and 582*b* to the drive signal generator 61C as the output signals without changing the received signals. In this case, the signals (calculation results) output when the average arm angle θc of the arm angles of the first and second front work devices A and B increases are the same as the signals (calculation results) output when the average arm angle θc of the arm angles of the first and second front work devices A and B is reduced.

(2) Stable State Limit Range M

When the average arm angle θc of the arm angles of the first and second front work devices A and B is in the stable state limit range M and the input signal from the control lever front-back direction displacement detectors 582*a* and 582*b* corresponds to a signal for which the average arm angle θc will increase, the operating range calculator 61F multiplies the signals received from the control lever front-back direction displacement detectors 582*a* and 582*b* by the value $\alpha(0<\alpha<1)$ to reduce values of the received signals, and outputs the calculated signals to the drive signal generator 61C as the output signals (calculation results).

When the average arm angle θc of the arm angles of the first and second front work devices A and B is in the stable state limit range M and the input signal from the control lever front-back direction displacement detectors 582*a* and 582*b* corresponds to a signal for which the average arm angle θc will decrease, the operating range calculator 61F outputs the signals received from the control lever front-back direction displacement detectors 582*a* and 582*b* to the drive signal generator 61C as the output signals (calculation results) without changing the received signals.

(3) Unstable range N

When the average arm angle θc of the arm angles of the first and second front work devices A and B is in the unstable range N and the input signal from the control lever front-back direction displacement detectors 582*a* and 582*b* corresponds to a signal for which the average arm angle θc will increase, the operating range calculator 61F multiplies the signals received from the control lever front-back direction displacement detectors 582*a* and 582*b* by zero to reduce the values of the received signals, and treats the multiplied signals as the output signals (calculation results). In this case, the operating range calculator 61F does not output the signals to the drive signal generator 61C.

When the average arm angle θc of the arm angles of the first and second front work devices A and B is in the stable state limit range M and the input signal from the control lever front-back direction displacement detectors 582*a* and 582*b* corresponds to a signal for which the average arm angle θc will reduce, the operating range calculator 61F outputs the signals received from the control lever front-back direction displacement detectors 582*a* and 582*b* to the drive signal generator 61C as the output signals (calculation results) without changing the received signals.

The operating range calculation performed by the operating range calculator 61F is switched between the active mode and the inactive mode by the operating range calculator switch 110, as described above. The calculation results of (or signals output from) the operating range calculator 61F when the operating range calculation is switched to the active mode are described above.

When the operating range calculation is switched to the inactive mode by the operating range calculator switch 110, the operating range calculator 61F does not perform the operating range calculation. Therefore, the operating range calculator 61F outputs the signals received from the control lever front-back direction displacement detectors 582*a* and 582*b* to the drive signal generator 61C as the output signals without changing the received signals. These output signals do not depend on the average arm angle θc of the arm angles of the front work devices A and B.

Effects of the present embodiment constituted as mentioned above are described below.

When the total weight of the front work devices A and B of the dual arm working machine (dual arm hydraulic excavator 200) is the same as the weight of the front work device of the single arm working machine (single arm working machine having the same engine power as that of the dual arm working machine) belonging to the same class as the dual arm working machine, the stability (static balance) of the dual arm working machine is the same as that of the single arm working machine. The engine power required to operate the two front work devices is in a nearly proportional relationship to the total intensity of the two front work devices. The total intensity of the two front work devices is in a nearly proportional relationship to the total weight of the two front work devices. Therefore, when the engine power required to operate the front work devices A and B of the dual arm working machine is increased, the total weight of the front work devices A and B of the dual arm working machine is increased. This leads to the fact that the stability of the dual arm working machine may be reduced compared with the single arm working machine belonging to the same class as the dual arm working machine. In the present embodiment, the range in which the average arm angle θc of the arm angles of the front work devices A and B is equal to or larger than the threshold value θc2 is defined as the unstable range N, and the operations of the front work devices A and B are controlled to ensure that the average arm angle θc is not in the unstable range N. The threshold value θc2 is set in consideration of the stability of the single arm working machine belonging to the same class as the dual arm working machine. This ensures the same stability of the dual arm working machine as the single arm working machine and suppresses a reduction in the stability of the dual arm working machine due to an increase in the engine power required to operate the front work devices A and B.

The unstable range N is adjacent to the stable state limit range M. When the average arm angle θc is in the stable state limit range M and approaches the unstable range N, the operating speeds of the front work devices A and B are controlled. Therefore, the front work devices A and B can be stopped after the operating speeds of front work devices A and B are gradually reduced.

The operations of the front work devices A and B are controlled based on the average arm angle θc of the arm angles of the front work devices A and B. Therefore, when the arm angle of one of the front work devices A and B is minimized, the operating range of the other of the front work devices A and B can be maximized.

According to the present embodiment, when the average arm angle θc of the arm angles of the front work devices A and B is in the stable state limit range M and the input signal from the control lever front-back direction displacement detectors 582*a* and 582*b* corresponds to a signal for which the average arm angle θc will decrease, the operating range calculator 61F outputs the signals received from the control lever front-back direction displacement detectors 582*a* and 582*b* to the drive signal generator 61C as the output signals (calculation results) without changing the received signals. The dual arm working machine is not limited to this. When the average arm angle θc of the arm angles of the front work devices A and B is in the stable state limit range M and the input signal from the control lever front-back direction displacement detectors 582*a* and 582*b* corresponds to a signal for which the average arm angle θc will decrease, the operating range calculator 61F may multiply the signals received from the control lever front-back direction displacement detectors 582*a* and 582*b* by the value α to output the multiplied signals to the drive signal generator 61C as the output signals (calculation results).

Another example of the first embodiment of the present invention is described below with reference to FIG. 10.

Figure 10:
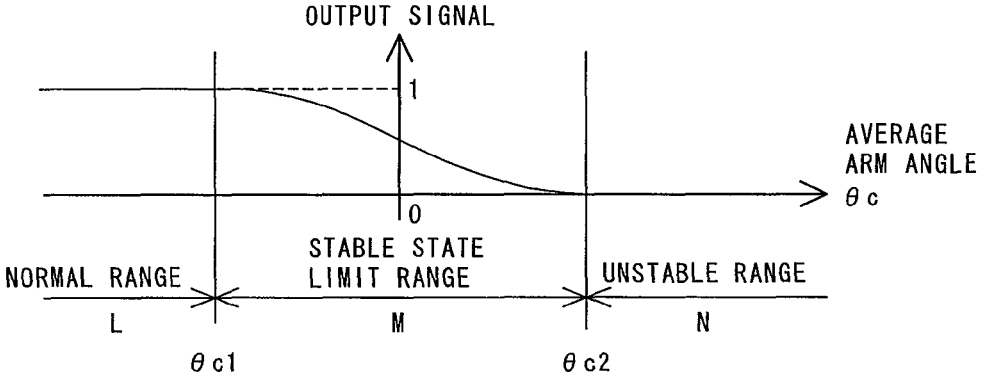
FIG. 10 is a diagram showing another example of the relationship between the average arm angle and the magnitudes of the signals output by the operating range calculator.

FIG. 10 is a diagram showing another example of the relationship between the average arm angle θc and the magnitudes of signals (calculation results) output by the operating range calculator 61F when the average arm angle θc of the arm angles of the first and second front work devices A and B increases. An abscissa axis and an ordinate axis in the diagram of FIG. 10 are the same as those in the diagram of FIG. 9.

In the example shown in FIG. 10, the signals to be output by the operating range calculator 61F when the average arm angle θc is in the stable state limit range M are set to ensure that the values of the signals are continuously reduced from 1 to 0 (zero) as the average arm angle θc approaches the unstable range N. In the example shown in FIG. 10, the signals to be output by the operating range calculator 61F when the average arm angle θc is in the stable state limit range M are defined based on a nonlinear line not including a discontinuous point. In this case, the closer to the unstable range N the average arm angle θc of the arm angles of the first and second front work devices A and B, the more driving speeds of the arms 12*a* and 12*b* are suppressed. This makes it possible to stop the arm cylinders 13*a* and 13*b* after the speeds of the arm cylinders 13*a* and 13*b* are gradually reduced. In the present embodiment, since the relationship between the average arm angle θc and the output signals (calculation results) is defined based on the nonlinear line not including a discontinuous point, the operations of the arms 12*a* and 12*b* can be stopped more smoothly.

It should be noted that the line (relationship between the average arm angle θc and the magnitudes of the signals (calculation result) output by the operating range calculator 61F) shown in FIG. 10 may be a parabola or an arc.

Another example of the first embodiment of the present invention is described below with reference to FIG. 11.

Figure 11:
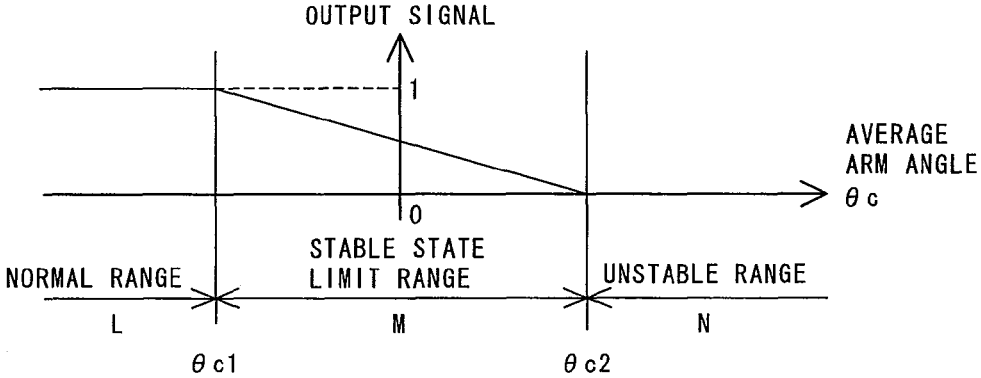
FIG. 11 is a diagram showing still another example of the relationship between the average arm angle and the magnitudes of the signals output by the operating range calculator.

FIG. 11 is a diagram showing the relationship between the average arm angle θc and the magnitudes of the signals (calculation results) output by the operating range calculator 61F when the average arm angle θc of the arm angles of the first and second front work devices A and B is increased. An abscissa axis and an ordinate axis in the diagram of FIG. 11 are the same as those in the diagram of FIG. 9.

In the example shown in FIG. 11, the signals to be output by the operating range calculator 61F when the average arm angle θc is in the stable state limit range M are set to ensure that the values of the signals are continuously reduced from 1 to 0 (zero) as the average arm angle θc approaches the unstable range N. In this example, the signals to be output by the operating range calculator 61F when the average arm angle θc is in the stable state limit range M are defined based on a linear line that is inclined at a constant angle with respect to the abscissa axis. In the example shown in FIG. 11, the values of the signals output when the average arm angle θc is in the normal range L, and the values of the signals output when the average arm angle θc is in the stable state limit range M, are discontinuous. In addition, the values of the signals output when the average arm angle θc is in the stable state limit range M, and the values of the signals output when the average arm angle θc is in the unstable range N, are discontinuous. In this case, the closer to the unstable range N the average arm angle θc of the arm angles of the first and second front work devices A and B, the more the driving speeds of the arms 12*a* and 12*b* are suppressed. This makes it possible to stop the arm cylinders 13*a* and 13*b* after the speeds of the arm cylinders 13*a* and 13*b* are gradually reduced, compared with the example shown in FIG. 9.

Another example of the first embodiment of the present invention is described below with reference to FIGS. 12 to 14.

Figure 12:
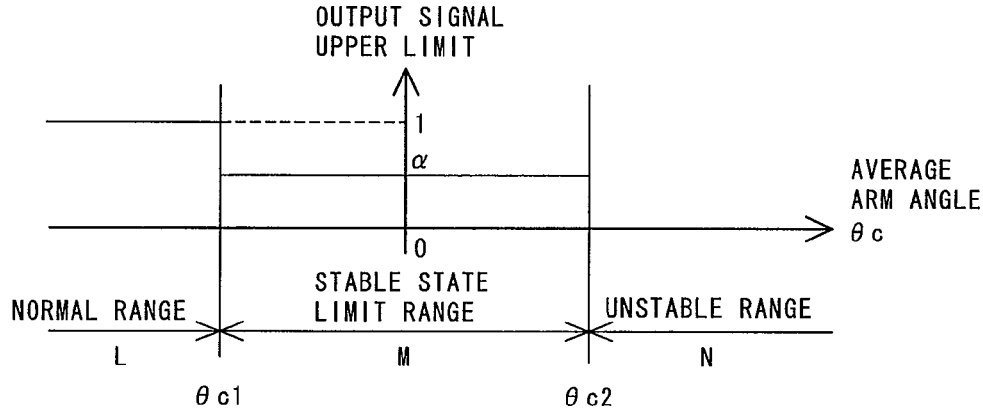
FIG. 12 is a diagram showing a modified example of the relationship between the average arm angle and the magnitudes of the signals output by the operating range calculator.
Figure 13:
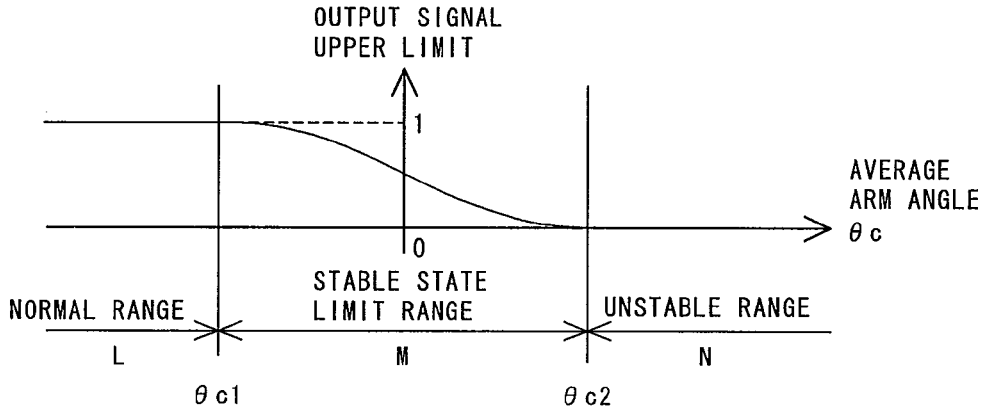
FIG. 13 is a diagram showing a modified example of the relationship between the average arm angle and the magnitudes of the signals output by the operating range calculator.
Figure 14:
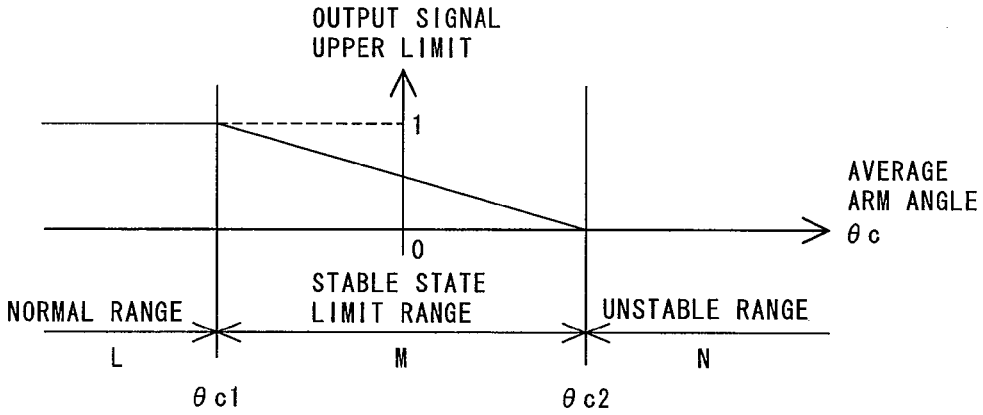
FIG. 14 is a diagram showing a modified example of the relationship between the average arm angle and the magnitudes of the signals output by the operating range calculator.

Each of FIGS. 12 to 14 is a diagram showing a modified example of the relationship between the average arm angle θc of the arm angles of the first and second front work devices A and B and the magnitudes of the signals (calculation results) output by the operating range calculator 61F when the average arm angle θc increases. In each of FIGS. 12 to 14, the average arm angle θc is plotted along an abscissa axis (in the same manner as in FIG. 9), and an upper limit of the output signal is plotted along an ordinate axis.

In the examples shown in FIGS. 9 to 11, the signals to be output are calculated by multiplying the signals received when the average arm angle θc is in the stable state limit range M by the coefficient in order to reduce the driving speeds of the arms 12*a* and 12*b*. In the examples shown in FIGS. 12 to 14, upper limits of the driving speeds of the arms are set to limit the operating speeds of the arms 12*a* and 12*b* of the front work devices A and B when the average arm angle θc is in the stable state limit range M. Therefore, the operating speeds of the arms 12*a* and 12*b* are reduced. Even when the operating amount is maximal, the output signal is suppressed to be a level equal to or lower than the upper limit. This can obtain a similar effect to those in the examples shown in FIGS. 9 to 11.

It should be noted that the line (relationship between the average arm angle θc and the magnitudes of the signals (calculation results) output by the operating range calculator 61F) shown in FIG. 13 may be a parabola or an arc.

The second embodiment of the present invention is described below with reference to FIGS. 15 to 17.

In the first embodiment, the range of the average arm angle θc is divided into the ranges defined as the unstable range N, the stable state limit range M and the normal range L, and the operations of the front work devices A and B are controlled based on the average arm angle θc. In the second embodiment, an unstable range N, a stable state limit range M and a normal range L are defined in terms of the average of horizontal coordinates of the arms 12*a* and 12*b*, and the operations of the front work devices A and B are controlled based on the average of the horizontal coordinates of the arms 12*a* and 12*b* to suppress a reduction in stability of the front work devices A and B. The horizontal coordinates of the arms 12*a* and 12*b* of the front work devices A and B are calculated based on the relative angles (boom angles) of the booms 10*a* and 10*b* to the upper swing structure 3, the relative angle (arm angle) of the arm 12*a* to the boom 10*a*, and the relative angle (arm angle) of the arm 12*b* to the boom 10*b*.

FIG. 15 is a functional block diagram showing a control system for the first and second front work devices A and B according to the present embodiment. It should be noted that the parts (shown in FIG. 15) for the second front work device B are indicated by symbols "b" represented in parentheses shown in FIG. 15. In FIG. 15, the same parts as those shown in FIG. 4 are indicated by the same reference numerals as those shown in FIG. 4, and description thereof is omitted.

The control system shown in FIG. 15 has boom angle detectors 68*a* and 68*b* and the input system according to the first embodiment. In addition, the control system shown in FIG. 15 has a control unit 261 instead of the control unit 61. Specifically, the control system according to the present embodiment has the displacement detectors, the operating range calculator switch 110, the input system, the control unit 261, and the output system, like the control system according to the first embodiment. The displacement detectors of the control system according to the present embodiment are provided in the operating devices 50*a* and 50*b* located in the cab 4 in the same manner as in the first embodiment. The input system of the control system according to the present embodiment is composed of the angle detectors provided at the first and second front work devices A and B. The control unit 261 performs a predetermined calculation based on signals (control signal, command signal and detection signal) received from the input system to generate and output drive signals. The output system of the control system according to the present embodiment is composed of drive systems that receive the drive signals from the control unit 261 and operate the portions of the first and second front work devices A and B based on the received drive signals.

The input system for the control unit 261 includes the control arm displacement detectors 57*a* and 57*b*, the control lever top-bottom direction displacement detectors 581*a* and 581*b*, the control lever front-back direction displacement detectors 582*a* and 582*b*, the working device pivot lever displacement detectors 59*a* and 59*b*, the working device control switch displacement detectors 60*a* and 60*b*, the operating range calculator switch 110 and the arm angle detectors 69*a* and 69*b*, which are the same as those in the first embodiment. In addition, the input system for the control unit 261 has boom angle detectors 68*a* and 68*b*. The boom angle detectors 68*a* and 68*b* detect angles of the booms of the first and second front work devices A and B to transmit signals (detection signals), respectively.

The output system for the control unit 261 includes the swing post cylinder drive systems 62*a* and 62*b*, the boom cylinder drive systems 63*a* and 63*b*, the arm cylinder drive systems 64*a* and 64*b*, the working device cylinder drive systems 65*a* and 65*b*, and the working device drive systems 66*a* and 66*b*, which are the same as those in the first embodiment.

The control unit 261 has the operating range calculator switch 110, the arm angle detectors 69*a* and 69*b*, the control lever front-back direction displacement detectors 582*a* and 582*b*, and the control lever top-bottom direction displacement detectors 581*a* and 581*b*, in the inputs, an operating range calculator 261F, and the drive signal generators 61A, 61B, 61C, 61D and 61E. The operating range calculator 261F performs an operating range calculation based on signals (control signals) received from the boom angle detectors 68*a* and 68*b*. The drive signal generator 61C included in the control unit 261 generates drive signals (to be transmitted to the arm cylinder drive systems 64*a* and 64*b*) based on signals (calculation results) received from the operating range calculator 261F. The drive signal generator 61B generates drive signals (to be transmitted to the boom cylinder drive systems 63*a* and 63*b*) based on signals (calculation results) received from the operating range calculator 261F. The drive signal generator 61A generates drive signals (to be transmitted to the swing post cylinder drive systems 62*a* and 62*b*) based on signals received from the control arm displacement detectors 57*a* and 57*b*. The drive signal generator 61D generates drive signals (to be transmitted to the working device cylinder drive systems 65*a* and 65*b*) based on signals received from the working device pivot lever displacement detectors 59*a* and 59*b*. The drive signal generator 61E generates drive signals (to be transmitted to the working device drive systems 66*a* and 66*b*) based on signals received from the working device control switch displacement detectors 60*a* and 60*b*.

Next, contents of the operating range calculation performed by the operating range calculator 261F of the control unit 261 are described below with reference to FIGS. 16 to 17.

Figure 16:
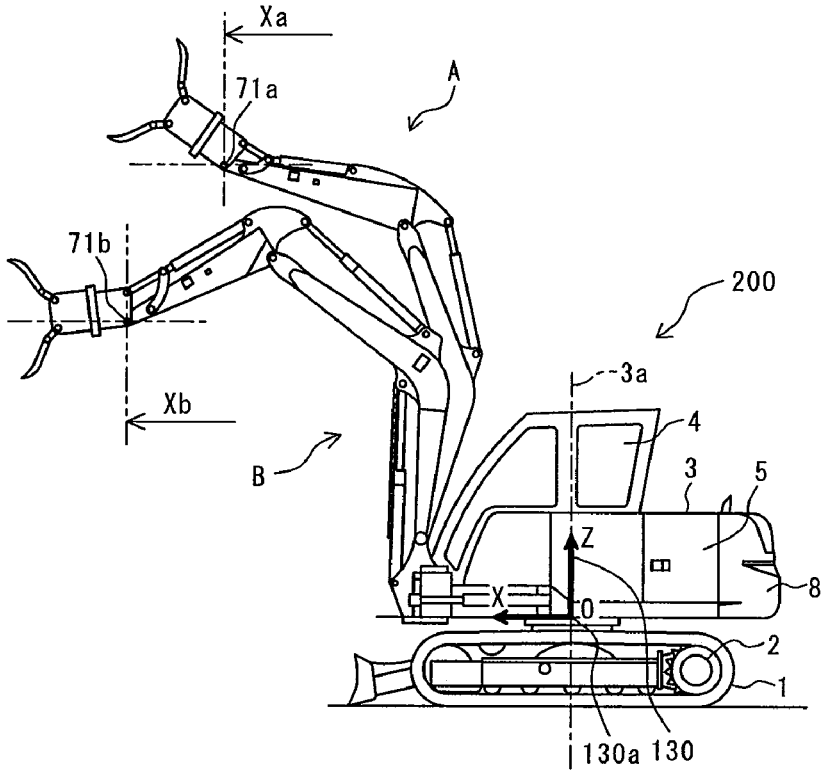
FIG. 16 is a diagram showing horizontal coordinates of the arms of the first and second front work devices.

FIG. 16 is a side view of the appearance of the dual arm hydraulic excavator 200 according to the present embodiment and shows horizontal coordinates of the arms of the first and second front work devices A and B.

As shown in FIG. 16, a standard coordinate system 130 is set. In the standard coordinate system 130, a point that connects the upper swing structure 3 with the lower travel structure 2 and is present on a rotational axis 3*a* of the upper swing structure 3 is defined as an original point 130*a*; the rotational axis 3*a* is defined as a Z axis; and an axis perpendicular to the Z axis and parallel to a front-back direction of the upper swing structure 3 is defined as an X axis. End portions of the first and second front work devices A and B, which are respectively connected with the working devices 20*a* and 20*b*, are defined as arm ends 71*a* and 71*b*. A horizontal component of the distance between the original point 130*a* of the standard coordinate system 130 set in the aforementioned way and the arm end 71*a* of the arm 12*a* of the first front work device A is defined as an arm horizontal coordinate Xa. A horizontal component of the distance between the original point 130*a* and the arm end 71*b* of the arm 12*b* of the second front work device B is defined as an arm horizontal coordinate Xb. The average of the horizontal arm coordinates Xa and Xb is defined as an average arm horizontal coordinate Xc (=(Xa+Xb)/2). A direction toward the front of the upper swing structure 3 is defined as a positive direction for the horizontal arm coordinates Xa and Xb. When the arms 12*a* and 12*b* are driven and moved toward dump areas, the horizontal arm coordinates Xa and Xb increase.

Figure 17:
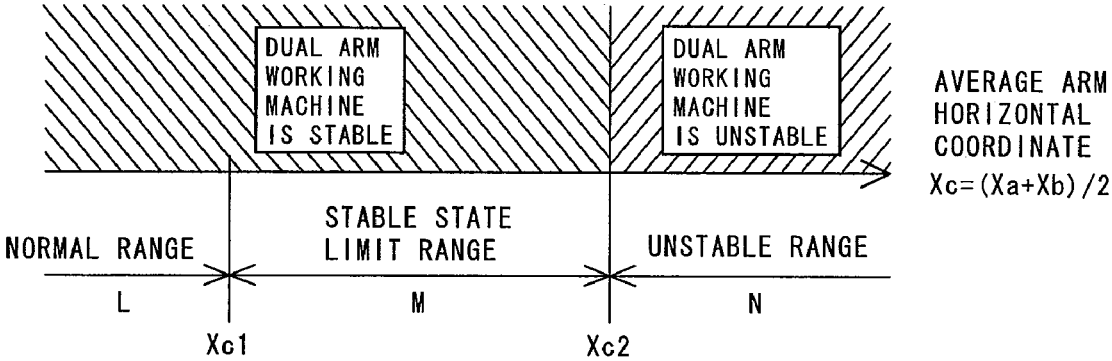
FIG. 17 is a conceptual diagram showing the relationship between an average arm horizontal coordinate and stability of a dual arm working machine.

FIG. 17 is a conceptual diagram showing the relationship between the average arm horizontal coordinate Xc and the stability of the dual arm working machine.

In FIG. 17, the average arm horizontal coordinate Xc is plotted along an abscissa axis. When the average arm horizontal coordinate Xc is smaller than a threshold value Xc2, the state of the dual arm hydraulic excavator 200 is defined as a stable state (the dual arm working machine is stable). When the average arm horizontal coordinate Xc is larger than the threshold value Xc2, the state of the dual arm hydraulic excavator 200 is defined as an unstable state (the dual arm working machine is unstable). A method for defining the threshold value Xc2 is not limited. For example, the threshold value Xc2 may be equal to (or lower than) the average arm horizontal coordinate Xc obtained when the stability (static balance) of the dual arm working machine (dual arm hydraulic excavator 200) according to the present embodiment is the same as that of a single arm working machine (single arm working machine having the same engine power as that of the dual arm working machine) belonging to the same class as the dual arm working machine. The operating range calculator 261F has the threshold value Xc2 stored therein. The range of the average arm horizontal coordinate Xc, in which the average arm horizontal coordinate Xc is equal to or larger than the threshold value Xc2 and the dual arm hydraulic excavator 200 is in the unstable state, is defined as an unstable range N.

When Xc<Xc2, and each of the front work devices A and B is in a stop state, the dual arm working machine does not become unstable. However, when Xc<Xc2, and the front work devices A and B operate, it may be difficult to rapidly stop the front work devices A and B. Even when the front work devices A and B operate under the condition that the average arm horizontal coordinate Xc is in a range in which the dual arm working machine is stable, the front work devices A and B may operate under the condition that the average arm horizontal coordinate Xc is close to the unstable range N and the average arm horizontal coordinate Xc may increase. In such a case, the average arm horizontal coordinate Xc may be in the unstable range N and the dual arm working machine may be unstable depending on the operating speeds. To avoid this, the operating speeds of the front work devices A and B are reduced when the average arm horizontal coordinate Xc is in a range adjacent to the unstable range N. In consideration of a margin to stop the operations of the front work devices A and B before the dual arm working machine becomes unstable, a threshold value Xc1 (<Xc2) is set. The operating range calculator 261F has the threshold value Xc1 stored therein. A range of the average arm horizontal coordinate Xc, in which the average arm horizontal coordinate Xc is equal to or larger than the threshold value Xc1 and smaller than the threshold value Xc2 and which is adjacent to the unstable range N, is defined as a stable state limit range M by the dual arm hydraulic excavator 200.

A range of the average arm horizontal coordinate Xc, in which the average arm horizontal coordinate Xc is smaller than the threshold value Xc1 and the dual arm working machine does not become unstable regardless of the states of the operations of the front work devices A and B, is defined as a normal range L.

The average arm horizontal coordinate Xc is a stability determination value used to evaluate and determine the stability (changing depending on the positions of the front work devices A and B) of the dual arm working machine, while the threshold value Xc2 is a stability determination standard value.

In the present embodiment, when the operating range calculation performed by the operating range calculator 261F is in the active mode and the average arm horizontal coordinate Xc of the horizontal arm coordinates of the arms 12*a* and 12*b* of the first and second front work devices A and B increases, the relationship between the average arm horizontal coordinate Xc and the magnitudes of signals (calculation results) output by the operating range calculator 261F is the same as the relationship shown in FIG. 9 according to the first embodiment. In this case, the threshold values θc1 and θc2 shown in FIG. 9 are replaced with the threshold values Xc1 and Xc2, and the average arm angle θc shown in FIG. 9 is replaced with the average arm horizontal coordinate Xc. That is, when the average arm horizontal coordinate Xc is in the normal range L, the values of the signals output by the operating range calculator 261F are 1. The signals indicating 1 are output from the operating range calculator 261F as the output signals (calculation results) without changing the received signals. When the average arm horizontal coordinate Xc is in the stable state limit range M, the operating range calculator 261F multiplies the received signals by the value $\alpha(0<\alpha<1)$ to reduce the received signals and outputs the reduced signals (calculation results). When the average arm horizontal coordinate Xc is in the unstable range N, the operating range calculator 261F multiplies the received signals by 0 (zero). In this case, the calculated signals are the calculation results, and the operating range calculator 261F does not output the calculated signals.

Next, a description is made of procedures for calculating the signals to be output from the operating range calculator 261F when the average arm horizontal coordinate Xc is in each of the ranges.

(1) Normal Range L

When the average arm horizontal coordinate Xc of the horizontal arm coordinates of the arms 12*a* and 12*b* of the first and second front work devices A and B is in the normal range L, i.e., is on the outer side of the stable state limit range M, the operating range calculator 261F outputs the signals received from the control lever front-back direction displacement detectors 582*a* and 582*b* to the drive signal generator 61C as the output signals without changing the received signals, and outputs the signals received from the control lever top-bottom direction displacement detectors 581*a* and 581*b* to the drive signal generator 61B without changing the received signals. In this case, the output signals (calculation results) obtained when the average arm horizontal coordinate Xc increases are the same as the output signals (calculation results) obtained when the average arm horizontal coordinate Xc is reduced.

(2) Stable State Limit Range M

When the average arm horizontal coordinate Xc of the horizontal arm coordinates of the arms 12*a* and 12*b* of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average arm horizontal coordinate Xc will increase, the operating range calculator 261F multiplies the signals received from the control lever front-back direction displacement detectors 582*a* and 582*b* by the value α to output the multiplied signals to the drive signal generator 61C as the output signals (calculation results), and multiplies the signals received from the control lever top-bottom direction displacement detectors 581*a* and 581*b* by the value α to output the multiplied signals to the drive signal generator 61B as the output signals (calculation results).

When the average arm horizontal coordinate Xc of the horizontal arm coordinates of the arms 12*a* and 12*b* of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average arm horizontal coordinate Xc will decrease, the operating range calculator 261F outputs the signals received from the control lever front-back direction displacement detectors 582*a* and 582*b* to the drive signal generator 61C as the output signals (calculation results) without changing the received signals, and outputs the signals received from the control lever top-bottom direction displacement detectors 581*a* and 581*b* to the drive signal generator 61B as the output signals (calculation results) without changing the received signals.

(3) Unstable Range N

When the average arm horizontal coordinate Xc of the horizontal arm coordinates of the arms 12*a* and 12*b* of the first and second front work devices A and B is in the unstable range N and the input signal from the control lever front-back direction displacement detectors 582*a* and 582*b* and the control lever top-bottom direction displacement detectors 581*a* and 581*b* corresponds to a signal for which the average arm horizontal coordinate Xc will increase, the operating range calculator 261F multiplies the signals received from the control lever front-back direction displacement detectors 581*a* and 582 by 0 (zero) to obtain the multiplied signals as the output signals (calculation results). In this case, the operating range calculator 261F does not output the multiplied signals to the drive signal generators 61C and 61B.

When the average arm horizontal coordinate Xc of the horizontal arm coordinates of the arms 12*a* and 12*b* of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average arm horizontal coordinate Xc will decrease, the operating range calculator 261F outputs the signals received from the control lever front-back direction displacement detectors 582*a* and 582*b* to the drive signal generator 61C as the output signals (calculation results) without changing the received signals, and outputs the signals received from the control lever top-bottom direction displacement detectors 581*a* and 581*b* to the drive signal generator 61B as the output signals (calculation results) without changing the received signals.

As described above, the operating range calculator switch 110 switches the mode of the operating range calculation to be performed by the operating range calculator 261F between the active mode and the inactive mode. The calculation results obtained by the operating range calculator 261F (the signals output by the operating range calculator 261F) when the operating range calculator switch 110 switches the mode of the operating range calculation to the active mode are described above.

On the other hand, when the operating range calculator switch 110 switches the mode of the operating range calculation to the inactive mode, the operating range calculator 261F does not perform the operating range calculation. Specifically, when the operating range calculator switch 110 switches the mode of the operating range calculator to the inactive mode, the operating range calculator 261F outputs the signal received from the control lever front-back direction displacement detectors 582*a* and 582*b* to the drive signal generator 61C as the output signals without changing the received signals, and outputs the signal received from the control lever top-bottom direction displacement detectors 581*a* and 581*b* to the drive signal generator 61B as the output signals without changing the received signals. The output signals obtained in this case do not vary depending on the average arm horizontal coordinate Xc of the horizontal arm coordinates of the arms 12*a* and 12*b* of the front work devices A and B.

The thus configured dual arm working machine according to the present embodiment can provide the same effect as the dual arm working machine according to the first embodiment.

In the present embodiment, when the average arm horizontal coordinate Xc of the horizontal arm coordinates of the arms 12*a* and 12*b* of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average arm horizontal coordinate Xc will decrease, the operating range calculator 261F outputs the signals received from the control lever front-back direction displacement detectors 582*a* and 582*b* to the drive signal generator 61C as the output signals (calculation results) without changing the received signals, and outputs the signals received from the control lever top-bottom direction displacement detectors 581*a* and 581*b* to the drive signal generator 61B as the output signals (calculation results) without changing the received signals. However, the configuration of the dual arm working machine according to the present embodiment is not limited to this. When the average arm horizontal coordinate Xc of the horizontal arm coordinates of the arms 12*a* and 12*b* of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average arm horizontal coordinate Xc will decrease, the operating range calculator 261F may multiply the signals received from the control lever front-back direction displacement detectors 582*a* and 582*b* by the value $\alpha$ to output the multiplied signals to the drive signal generator 61C as the output signals (calculation results), and multiply the signals received from the control lever top-bottom direction displacement detectors 581*a* and 581*b* by the value $\alpha$ to output the multiplied signals to the drive signal generator 61B as the output signals (calculation results).

As described above, when the operating range calculation performed by the operating range calculator 261F is in the active mode and the average arm horizontal coordinate Xc of the horizontal arm coordinates of the arms 12*a* and 12*b* of the first and second front work devices A and B increases, the relationship between the average arm horizontal coordinate Xc and the magnitudes of signals (calculation results) output by the operating range calculator 261F is the same as the relationship shown in FIG. 9 according to the first embodiment of the present invention. This relationship between the average arm horizontal coordinate Xc and the magnitudes of signals (calculation results) output by the operating range calculator 261F is not limited to the relationship shown in FIG. 9, and may be the same as any of the relationships shown in FIGS. 10 to 14. In this case, the same effect as that in the first embodiment can be obtained.

Next, the third embodiment of the present invention is described below with reference to FIGS. 18 to 20.

In the first embodiment, the unstable range N, the stable state limit range M and the normal range L are defined in terms of the average arm angle θc, and the operations of the two front work devices A and B are controlled based on the average arm angle θc. In the third embodiment, an unstable range N, a stable state limit range M and a normal range L are defined in terms of the average of static moments of the first and second front work devices A and B, and the operations of the first and second front work devices A and B are controlled based on the average of the static moments of the first and second front work devices A and B to suppress a reduction in stability of the front work devices A and B. The static moments of the front work devices A and B are calculated based on barycentric coordinates of the booms 10*a* and 10*b*, barycentric coordinates of the arms 12*a* and 12*b*, barycentric coordinates of the working devices 20*a* and 20*b*, the weights of the booms 10*a* and 10*b*, the weights of the arms 12*a* and 12*b*, and the weights of the working devices 20*a* and 20*b*, respectively. The barycentric coordinates of the booms 10*a* and 10*b*, the barycentric coordinates of the arms 12*a* and 12*b*, and the barycentric coordinates of the working devices 20*a* and 20*b*, are calculated based on the relative angles (boom angles) of the booms 10*a* and 10*b* to the upper swing structure 3, the relative angle (arm angle) of the arm 12*a* to the boom 10*a*, the relative angle (arm angle) of the arm 12*b* to the boom 10*b*, the relative angle (working device angle) of the working device 20*a* to the arm 12*a*, and the relative angle (working device angle) of the working device 20*b* to the arm 12*b*. The weights of the booms 10*a* and 10*b*, the weights of the arms 12*a* and 12*b*, and the weights of the working devices 20*a* and 20*b*, are calculated in advance and are known values.

Figure 18:
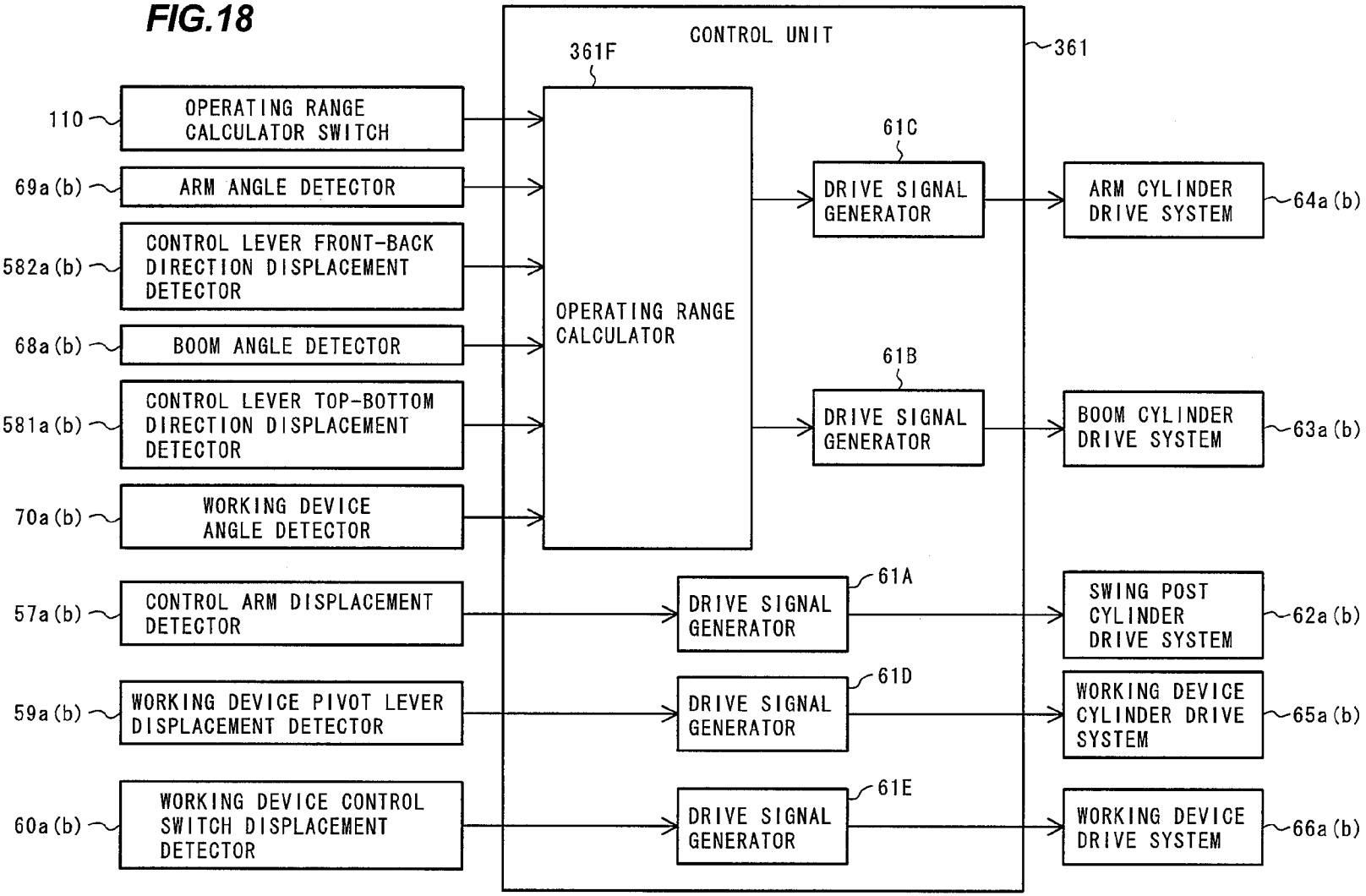
FIG. 18 is a functional block diagram of a control system for first and second front work devices according to a third embodiment of the present invention.

FIG. 18 is a functional block diagram showing a control system for the first and second front work devices A and B according to the present embodiment. It should be noted that the parts (shown in FIG. 18) for the second front work device B are indicated by symbols "b" represented in parentheses shown in FIG. 18. In FIG. 18, the same parts as those shown in FIG. 4 are indicated by the same reference numerals as those shown in FIG. 4, and description thereof is omitted.

The control system shown in FIG. 18 includes the input system according to the first embodiment, boom angle detectors 68*a* and 68*b*, and working device angle detectors 70*a* and 70*b*. In addition, the control system shown in FIG. 18 includes a control unit 361 instead of the control unit 61. Specifically, the control system according to the present embodiment has the displacement detectors, the operating range calculator switch 110, the input system, the control unit 361, and the output system. The displacement detectors of the control system according to the present embodiment are provided in the operating devices 50*a* and 50*b* located in the cab 4 in the same manner as in the first embodiment. The input system of the control system according to the present embodiment includes the angle detectors provided at the first and second front work devices A and B. The control unit 361 performs a predetermined calculation based on signals (control signal, command signal and detection signal) received from the input system to generate and output drive signals. The output system of the control system according to the present embodiment is composed of drive systems that receive the drive signals from the control unit 361 and operate the portions of the first and second front work devices A and B based on the received drive signals.

The input system for the control unit 361 includes the control arm displacement detectors 57*a* and 57*b*, the control lever top-bottom direction displacement detectors 581*a* and 581*b*, the control lever front-back direction displacement detectors 582*a* and 582*b*, the working device pivot lever displacement detectors 59*a* and 59*b*, the working device control switch displacement detectors 60*a* and 60*b*, the operating range calculator switch 110 and the arm angle detectors 69*a* and 69*b*, which are the same as those in the first embodiment.

In addition, the input system for the control unit 361 includes the boom angle detectors 68*a* and 68*b*, and the working device angle detectors 70*a* and 70*b*. The boom angle detectors 68*a* and 68*b* detect the angles of the booms 10*a* and 10*b* of the first and second front work devices A and B and transmit signals (detection signals), respectively. The working device angle detectors 70*a* and 70*b* detect the angles of the working devices 20*a* and 20*b* and transmit signals (detection signals), respectively.

The output system for the control unit 361 includes the swing post cylinder drive systems 62*a* and 62*b*, the boom cylinder drive systems 63*a* and 63*b*, the arm cylinder drive systems 64*a* and 64*b*, the working device cylinder drive systems 65*a* and 65*b*, and the working device drive systems 66*a* and 66*b*, which are the same as those in the first embodiment.

The control unit 361 has the operating range calculator switch 110, the arm angle detectors 69*a* and 69*b*, the control lever front-back direction displacement detectors 582*a* and 582*b*, and the control lever top-bottom direction displacement detectors 581*a* and 581*b*, in the inputs, an operating range calculator 361F, and the drive signal generators 61A, 61B, 61C, 61D and 61E. The operating range calculator 361F performs an operating range calculation based on signals (control signals) received from the boom angle detectors 68*a* and 68*b* and the working device angle detectors 70*a* and 70*b*. The drive signal generator 61C included in the control unit 361 generates drive signals (to be transmitted to the arm cylinder drive systems 64*a* and 64*b*) based on signals (calculation results) received from the operating range calculator 361F. The drive signal generator 61B included in the control unit 361 generates drive signals (to be transmitted to the boom cylinder drive systems 63*a* and 63*b*) based on signals (calculation results) received from the operating range calculator 361F. The drive signal generator 61A included in the control unit 361 generates drive signals (to be transmitted to the swing post cylinder drive systems 62*a* and 62*b*) based on signals received from the control arm displacement detectors 57*a* and 57*b*. The drive signal generator 61D included in the control unit 361 generates drive signals (to be transmitted to the working device cylinder drive systems 65*a* and 65*b*) based on signals received from the working device pivot lever displacement detectors 59*a* and 59*b*. The drive signal generator 61E included in the control unit 361 generates drive signals (to be transmitted to the working device drive systems 66*a* and 66*b*) based on signals received from the working device control switch displacement detectors 60*a* and 60*b*.

Next, contents of an operating range calculation performed by the operating range calculator 361F of the control unit 361 are described below with reference to FIGS. 19 and 20.

Figure 19:
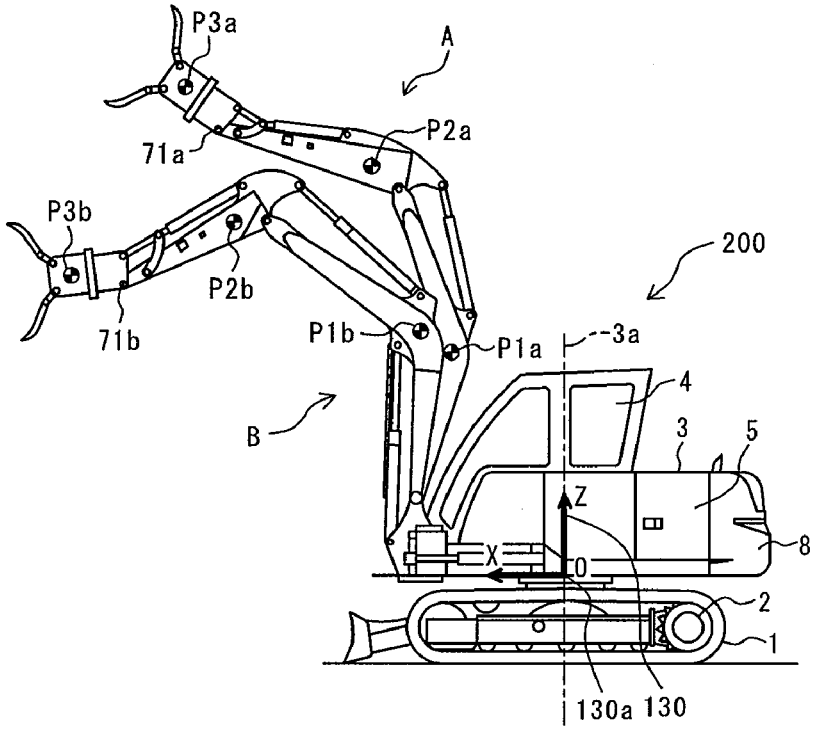
FIG. 19 is a diagram showing barycentric coordinates of booms, arms and working devices, which are included in the first and second front work devices.

FIG. 19 is a side view of the appearance of a dual arm hydraulic excavator 200 according to the present embodiment and shows barycentric coordinates of the arms, booms and working devices of the first and second front work devices A and B.

As shown in FIG. 19, a standard coordinate system 130 is set. In the standard coordinate system 130, a point that connects the upper swing structure 3 with the lower travel structure 2 and is present on a rotational axis 3*a* of the upper swing structure 3 is defined as an original point 130*a*; the rotational axis 3*a* is defined as a Z axis; an axis perpendicular to the Z axis and parallel to a front-back direction of the upper swing structure 3 is defined as an X axis; the barycentric position of the boom 10*a* of the first front work device A is defined as a position P1*a*; the barycentric position of the arm 12*a* of the first front work device A is defined as a position P2*a*; the barycentric position of the working device 20*a* of the first front work device A is defined as a position P3*a*; the barycentric position of the boom 10*b* of the second front work device B is defined as a position P1*b*; the barycentric position of the arm 12*b* of the second front work device B is defined as a position P2*b*; and the barycentric position of the working device 20*b* of the second front work device B is defined as a position P3*b*. In the present embodiment, symbols indicating the barycentric positions of the parts of the two front work devices A and B are the same as symbols indicating the coordinates (barycentric coordinates) of the barycentric positions of the parts of the two front work devices A and B in the standard coordinate system 130. That is, the barycentric coordinates of the boom 10*a* of the first front work device A are represented by the symbol P1*a*; the barycentric coordinates of the arm 12*a* of the first front work device A are represented by the symbol P2*a*; the barycentric coordinates of the working device 20*a* of the first front work device A are represented by the symbol P3*a*; the barycentric coordinates of the boom 10*b* of the second front work device B are represented by the symbol P1*b*; the barycentric coordinates of the arm 12*b* of the second front work device B are represented by the symbol P2*b*; and the barycentric coordinates of the working device 20*b* of the second front work device B are represented by the symbol P3*b*.

The operating range calculator 361F calculates the barycentric coordinates P1*a*, P2*a*, P1*a*, P1*b*, P2*b* and P3*b* through the following procedures.

First, the operating range calculator 361F calculates the relative angles (boom angles) of the booms 10*a* and 10*b* to the upper swing structure 3, the relative angle (arm angle) of the arm 12*a* to the boom 10*a*, the relative angle (arm angle) of the arm 12*b* to the boom 10*b*, the relative angle (working device angle) of the working device 20*a* to the arm 12*a*, and the relative angle (working device angle) of the working device 20*b* to the arm 12*b*. The operating range calculator 361F uses the boom angles, the arm angles and the working device angles to calculate the barycentric coordinates of the boom 10*a* in the standard coordinate system 130, the barycentric coordinates of the boom 10*b* in the standard coordinate system 130, the barycentric coordinates of the arm 12*a* in the standard coordinate system 130, the barycentric coordinates of the arm 12*b* in the standard coordinate system 130, the barycentric coordinates of the working device 20*a* in the standard coordinate system 130 and the barycentric coordinates of the working device 20*b* in the standard coordinate system 130 from a relative barycentric coordinate table. The relative barycentric coordinate table indicates the relationships among the boom angles, the arm angles, the working device angles, the barycentric coordinates of the boom 10*a* in the standard coordinate system 130, the barycentric coordinates of the boom 10*b* in the standard coordinate system 130, the barycentric coordinates of the arm 12*a* in the standard coordinate system 130, the barycentric coordinates of the arm 12*b* in the standard coordinate system 130, the barycentric coordinates of the working device 20*a* in the standard coordinate system 130, and the barycentric coordinates of the working device 20*b* in the standard coordinate system 130. The operating range calculator 361F has the relative barycentric coordinate table stored therein.

The static moment of the first front work device A is represented by Ta. The static moment of the second front work device B is represented by Tb. The average of the static moments of the front work devices A and B is represented by Tc (=(Ta+Tb)/2). The static moment Ta of the first front work device A is calculated according to the following formula (1) by using an X axis component (P1*ax*) of the barycentric coordinates P1*a* of the boom 10*a*, an X axis component (P2*ax*) of the barycentric coordinates P2*a* of the arm 12*a*, an X axis component (P3*ax*) of the barycentric coordinates P1*a* of the working device 20*a*, the weight M1*a* of the boom 10*a* which is calculated and known in advance, the weight M2*a* of the arm 12*a* which is calculated and known in advance and the weight M3*a* of the working device 20*a* which is calculated and known in advance. The static moment Tb of the second front work device B is calculated in the same manner as the static moment Ta of the first front work device A. That is, the static moment Tb of the second front work device A is calculated according to the following formula (2) by using an X axis component (P1*bx*) of the barycentric coordinates P1*b* of the boom 10*b*, an X axis component (P2*bx*) of the barycentric coordinates P2*b* of the arm 12*b*, an X axis component (P3*bx*) of the barycentric coordinates P3*b* of the working device 20*b*, the weight M1*b* of the boom 10*b* which is calculated and known in advance, the weight M2*b* of the arm 12*b* which is calculated and known in advance and the weight M3*b* of the working device 20*b* which is calculated and known in advance.

$$Ta=M1a\times P1ax+M2a\times P2ax+M3a\times P3ax \quad (1)$$

$$Tb=M1b\times P1bx+M2b\times P2bx+M3b\times P3bx \quad (2)$$

Figure 20:
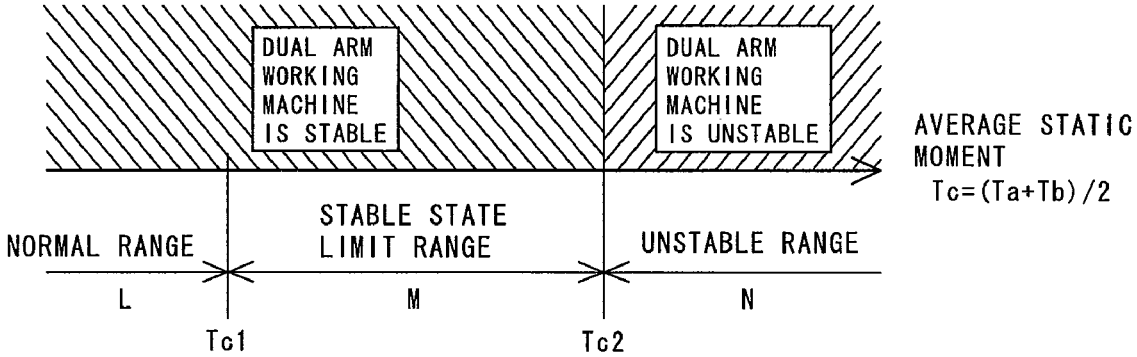
FIG. 20 is a conceptual diagram showing the relationship between the average of static moments of the first and second front work devices and stability of a dual arm working machine.

FIG. 20 is a conceptual diagram showing the relationship between the average Tc of the static moments of the front work devices A and B and the stability of the dual arm working machine.

In FIG. 20, the average Tc of the static moments of the front work devices A and B is plotted along an abscissa axis. The state where the average Tc is smaller than a threshold value Tc2 is defined as a stable state of the dual arm hydraulic excavator 200 (the dual arm working machine is in a stable state). The state where the average Tc is equal to or larger than the threshold value Tc2 is defined as a unstable state of the dual arm hydraulic excavator 200 (the dual arm working machine is in an unstable state). The method for defining the threshold value Tc2 is not limited. For example, the threshold value Tc2 may be equal to (or lower than) the average Tc obtained when the stability (static balance) of the dual arm working machine (dual arm hydraulic excavator 200) according to the present embodiment is the same as that of the single arm working machine (single arm working machine having the same engine power as that of the dual arm working machine) belonging to the same class as the dual arm working machine and extending its front work device forward to the maximum extent. In other words, the threshold value Tc2 may be equal to the average Tc (of the static moments of the front work devices A and B) obtained when the total of the static moments of the two front work devices A and B is equal to the maximum value of a static moment of the front work device of the single arm working machine belonging to the same class as the dual arm working machine. The operating range calculator 361F has the threshold value Tc2 stored therein. A range of the average of the static moments of the front work devices A and B, in which the average Tc is equal to or larger than the threshold value Tc2 and the dual arm hydraulic excavator 200 is in the unstable state, is defined as an unstable range N.

On the other hand, when the average Tc is lower than the threshold value Tc2, and each of the front work devices A and B is in a stop state, the dual arm working machine does not become unstable. However, it may be difficult to rapidly stop the operations of the front work devices A and B when the average Tc is lower than the threshold value Tc2. Even when the front work devices A and B operate under the condition that the dual arm working machine is in the stable state, the front work devices A and B may operate under the condition that the average Tc is close to the unstable range N and the average Tc may increase. In such a case, the average Tc may lie in the unstable range N and the dual arm working machine may become unstable depending on the operating speeds of the front work devices A and B. To avoid this, a threshold value Tc1 (<Tc2) is set in consideration of a margin to reduce the operating speeds of the front work devices A and B and stop the operations of the front work devices A and B before the dual arm working machine becomes unstable. The operating range calculator 361F has the threshold value Tc1 stored therein. A range of the average Tc of the static moments of the front work devices A and B, in which the average Tc is equal to or larger than the threshold value Tc1 and smaller than the threshold value Tc2 and which is adjacent to the unstable range N, is defined as a stable state limit range M. The stable state limit range M is adjacent to the unstable range N.

A range of the average Tc of the static moments of the front work devices A and B, in which the average Tc is smaller than the threshold value Tc1 and the dual arm working machine does not become unstable regardless of the states of the operations of the front work devices A and B, is defined as a normal range N.

The average Tc is a stability determination value used to evaluate and determine the stability (changing depending on the positions of the front work devices A and B) of the dual arm working machine. The threshold value Tc2 is a stability determination standard value.

In the present embodiment, when the operating range calculation performed by the operating range calculator 361F is in the active mode and the average Tc increases, the relationship between the average Tc and the magnitudes of signals (calculation results) output by the operating range calculator 361F is the same as the relationship shown in FIG. 9 according to the first embodiment of the present invention. In this case, the threshold values θc1 and θc2 shown in FIG. 9 are replaced with the threshold values Tc1 and Tc2, and the average arm angle θc shown in FIG. 9 is replaced with the average Tc. That is, when the average Tc is in the normal range L, the values of the signals output by the operating range calculator 361F are 1. The signals indicating 1 are output from the operating range calculator 361F as the output signal (calculation result) without changing the received signals. When the average Tc is in the stable state limit range M, the operating range calculator 361F multiplies the received signals by a value $\alpha(0<\alpha<1)$ to reduce the received signals and outputs the reduced signals (calculation results). When the average Tc is in the unstable range N, the operating range calculator 361F multiplies the received signals by 0 (zero). In this case, the calculated signals are the calculation result, and the operating range calculator 361F does not output the calculated signals.

Next, a description is made of procedures for calculating the signals to be output from the operating range calculator 361F when the average Tc is in each of the ranges.

(1) Normal Range L

When the average Tc of the static moments of the first and second front work devices A and B is in the normal range L, i.e., is on the outer side of the stable state limit range M, the operating range calculator 361F outputs the signals received from the control lever front-back direction displacement detectors 582*a* and 582*b* to the drive signal generator 61C as the output signal without changing the received signals, and outputs the signals received from the control lever top-bottom direction displacement detectors 581*a* and 581*b* to the drive signal generator 61B without changing the received signals. In this case, the output signals (calculation results) obtained when the average Tc of the static moments of the first and second front work devices A and B increases are the same as the output signals (calculation results) obtained when the average Tc of the static moments of the first and second front work devices A and B is reduced.

(2) Stable State Limit Range M

When the average Tc of the static moments of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average Tc of static moments will increase, the operating range calculator 361F multiplies the signals received from the control lever front-back direction displacement detectors 582*a* and 582*b* by the value α to output the multiplied signals to the drive signal generator 61C as the output signals (calculation results), and multiplies the signals received from the control lever top-bottom direction displacement detectors 581*a* and 581*b* by the value α to output the multiplied signals to the drive signal generator 61B as the output signals (calculation results).

When the average Tc of the static moments of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average Tc of static moments will decrease, the operating range calculator 361F outputs the signals received from the control lever front-back direction displacement detectors 582*a* and 582*b* to the drive signal generator 61C as the output signals (calculation results) without changing the received signals, and outputs the signals received from the control lever top-bottom direction displacement detectors 581*a* and 581*b* to the drive signal generator 61B as the output signals (calculation results) without changing the received signals.

(3) Unstable Range N

When the average Tc of the static moment of the first and second front work devices A and B is in the unstable range N and the input signal from the control lever front-back direction displacement detectors 582*a* and 582*b* and the control lever top-bottom direction displacement detectors 581*a* and 581*b* corresponds to a signal for which the average Tc of static moments will increase, the operating range calculator 361F multiplies the signals received from the control lever front-back direction displacement detectors 581*a* and 582*b* by 0 (zero) to obtain the multiplied signals as the output signals (calculation results). In this case, the operating range calculator 361F does not output the multiplied signals to the drive signal generators 61C and 61B.

When the average Tc of the static moment of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average Tc of static moments will decrease, the operating range calculator 361F outputs the signals received from the control lever front-back direction displacement detectors 582*a* and 582*b* to the drive signal generator 61C as the output signals (calculation results) without changing the received signals, and outputs the signals received from the control lever top-bottom direction displacement detectors 581*a* and 581*b* to the drive signal generator 61B as the output signals (calculation results) without changing the received signals.

As described above, the operating range calculator switch 110 switches the mode of the operating range calculation to be performed by the operating range calculator 361F between the active mode and the inactive mode. The calculation results obtained by the operating range calculator 361F (the signals output by the operating range calculator 361F) when the operating range calculator switch 110 switches the mode of the operating range calculation to the active mode are described above.

On the other hand, when the operating range calculator switch 110 switches the mode of the operating range calculation to the inactive mode, the operating range calculator 361F does not perform the operating range calculation. Specifically, when the operating range calculator switch 110 switches the mode of the operating range calculation to the inactive mode, the operating range calculator 361F outputs the signals received from the control lever front-back direction displacement detectors 582*a* and 582*b* to the drive signal generator 61C as the output signals without changing the received signals, and outputs the signals received from the control lever top-bottom direction displacement detectors 581*a* and 581*b* to the drive signal generator 61B as the output signals without changing the received signals. The output signals obtained in this case do not vary depending on the average Tc of the static moments of the front work devices A and B.

The thus configured dual arm working machine according to the present embodiment can provide the same effect as the dual arm working machine according to the first embodiment.

In the present embodiment, when the average Tc of the static moments of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average Tc of static moments will decrease, the operating range calculator 261F outputs the signals received from the control lever front-back direction displacement detectors 582*a* and 582*b* to the drive signal generator 61C as the output signals (calculation results) without changing the received signals, and outputs the signals received from the control lever top-bottom direction displacement detectors 581*a* and 581*b* to the drive signal generator 61B as the output signals (calculation results) without changing the received signals. However, the configuration of the dual arm working machine according to the present embodiment is not limited to this. When the average Tc of the static moments of the first and second front work devices A and B is in the stable state limit range M and the input signal from the control lever front-back direction displacement detectors 582*a* and 582*b* and the control lever top-bottom direction displacement detectors 581*a* and 581*b* corresponds to a signal for which the average Tc of static moments will decrease, the operating range calculator 361F may multiply the signals received from the control lever front-back direction displacement detectors 582*a* and 582*b* by the value α to output the multiplied signals to the drive signal generator 61C as the output signals (calculation results), and multiply the signals received from the control lever top-bottom direction displacement detectors 581*a* and 581*b* by the value α to output the multiplied signals to the drive signal generator 61B as the output signals (calculation results).

As described above, when the operating range calculation performed by the operating range calculator 361F is in the active mode and the average Tc of the static moments of the first and second front work devices A and B increases, the relationship between the average Tc and the magnitudes of signals (calculation results) output by the operating range calculator 361F is the same as the relationship shown in FIG.

9 according to the first embodiment of the present invention. This relationship between the average Tc and the magnitudes of signals (calculation results) output by the operating range calculator 361F is not limited to the relationship shown in FIG. 9, and may be the same as any of the relationships shown in FIGS. 10 to 14. In this case, the same effect as that in the first embodiment can be obtained.

The dual arm working machine has the working device angle detectors 70*a* and 70*b* that detect the relative angles of the working devices 20*a* and 20*b* to the arms 12*a* and 12*b*, respectively. The dual arm working machine may not have the working device angle detectors 70*a* and 70*b* and may use predetermined values as the relative angles of the working devices 20*a* and 20*b* to the arms 12*a* and 12*b*.

The barycentric coordinates are set for the booms 10*a* and 10*b*, the arms 12*a* and 12*b* and the working devices 20*a* and 20*b*. However, the barycentric coordinates may not be set for the booms 10*a* and 10*b*, the arms 12*a* and 12*b* and the working devices 20*a* and 20*b*, and multiple mass points for calculation may be set for each part of the front work devices A and B.

The invention claimed is:

1. A dual arm working machine including a lower travel structure having a travel device, an upper swing structure that is provided above the lower travel structure and has a cab, two front work devices that are provided swingably in top-bottom and left-right directions of the dual arm working machine, and are located on the right and left sides of a front portion of the upper swing structure, and have arms, booms and working devices, respectively, and operating devices that are provided in the cab and instruct the two front work devices to operate, the dual arm working machine comprising:

arm angle detectors that detect angles of the arms relative to the booms, respectively;

control part displacement detectors that detect operating directions of the operating devices and the amounts of operations of the operating devices; and an operating range calculator that calculates drive signals for the arms based on detection signals received from the arm angle detectors and on detection signals received from the control part displacement detectors, wherein, when a value used to evaluate and determine stability of the dual arm working machine is defined as a stability determination value, the stability changing depending on the positions of the front work devices, and when a range of the stability determination value, in which the dual arm working machine does not become an unstable state regardless of the states of the operations of the two front work devices, is defined as a normal range, a range of the stability determination value, which is present on an outer side of the normal range and adjacent to the normal range, is defined as a stable state limit range, a range of the stability determination value, which is present on an outer side of the stable state limit range and adjacent to the stable state limit range and in which the stability determination value is larger than a predetermined stability determination standard value, is defined as an unstable range, the operating range calculator calculates the stability determination value based on the arm angles detected by the arm angle detectors of the two front work devices; and when the stability determination value is in the stable state limit range and approaches the unstable range, the operating range calculator reduces values of the drive signals compared with values of the drive signals calculated when the stability determination value is in the normal range, and outputs the reduced drive signals to limit operating speeds of the arms.

2. The dual arm working machine according to claim 1, further comprising:

boom angle detectors that detect angles of the booms of the two front work devices relative to the upper swing structure, wherein the operating range calculator calculates drive signals for the booms and the arms based on detection signals received from the control part displacement detectors, detection signals received from the boom angle detectors and detection signals received from the arm angle detectors, and calculates the stability determination value based on the arm angles detected by the arm angle detectors of the two front work devices and on the boom angles detected by the boom angle detectors of the two front work devices, and when the stability determination value is in the stable state limit range and approaches the unstable range, the operating range calculator reduces the values of the drive signals compared with the values of the drive signals calculated when the stability determination value is in the normal range, and outputs the reduced drive signals to limit the operating speeds of the arms and the operating speeds of the booms.

3. The dual arm working machine according to claim 1, wherein the stability determination value (θc) is calculated based on the average of the angles (θa, θb) of the arms of the two front work devices (A, B).

4. The dual arm working machine according to claim 2, wherein the stability determination value is calculated based on the average of distances between arm ends of the arms of the two front work devices and the upper swing structure, the distances being calculated based on the angles of the booms of the front work devices and on the angles of the arms of the front work devices.

5. The dual arm working machine according to claim 1, wherein, when the stability determination value is in the stable state limit range and approaches the unstable range, the operating range calculator increases the rate of a reduction in the values of the drive signals in a continuous or stepwise manner as the stability determination value approaches the unstable range.

6. The dual arm working machine according to claim 1, wherein, when the stability determination value is in the unstable range and moves away from the stable state limit range, the operating range calculator stops outputting the drive signals to stop operations of the arms.

7. The dual arm working machine according to claim 2, wherein, when the stability determination value is in the stable state limit range and approaches the unstable range, the operating range calculator increases the rate of a reduction in the values of the drive signals in a continuous or stepwise manner as the stability determination value approaches the unstable range.

8. The dual arm working machine according to claim 3, wherein, when the stability determination value is in the stable state limit range and approaches the unstable range, the operating range calculator increases the rate of a reduction in the values of the drive signals in a continuous or stepwise manner as the stability determination value approaches the unstable range.

9. The dual arm working machine according to claim 4, wherein, when the stability determination value is in the stable state limit range and approaches the unstable range, the operating range calculator increases the rate of a reduction in the values of the drive signals in a continuous or stepwise manner as the stability determination value approaches the unstable range.

10. The dual arm working machine according to claim 2, wherein, when the stability determination value is in the unstable range and moves away from the stable state limit range, the operating range calculator stops outputting the drive signals to stop operations of the arms.

11. The dual arm working machine according to claim 3, wherein, when the stability determination value is in the unstable range and moves away from the stable state limit range, the operating range calculator stops outputting the drive signals to stop operations of the arms.

12. The dual arm working machine according to claim 4, wherein, when the stability determination value is in the unstable range and moves away from the stable state limit range, the operating range calculator stops outputting the drive signals to stop operations of the arms.

13. The dual arm working machine according to claim 5, wherein, when the stability determination value is in the unstable range and moves away from the stable state limit range, the operating range calculator stops outputting the drive signals to stop operations of the arms.

* * * * *